US008270874B2

(12) United States Patent
Iwase et al.

(10) Patent No.: US 8,270,874 B2
(45) Date of Patent: Sep. 18, 2012

(54) IMAGE FORMING APPARATUS HAVING FIXING UNIT PRESSURE RELEASE

(75) Inventors: Masaki Iwase, Suntou-gun (JP); Hiroyuki Tanaka, Numazu (JP); Kenji Ninomiya, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 220 days.

(21) Appl. No.: 12/754,869

(22) Filed: Apr. 6, 2010

(65) Prior Publication Data

US 2010/0254728 A1 Oct. 7, 2010

(30) Foreign Application Priority Data

Apr. 7, 2009 (JP) ..... 2009-093275
Jun. 8, 2009 (JP) ..... 2009-136797

(51) Int. Cl.
*G03G 15/16* (2006.01)
*G03G 21/00* (2006.01)

(52) U.S. Cl. ..... 399/122; 399/107; 399/124

(58) Field of Classification Search ..... 399/107, 399/122, 124, 328

See application file for complete search history.

(56) References Cited

U.S. PATENT DOCUMENTS 6,681,090 B2 * 1/2004 Cornelius ..... 399/122
7,269,379 B2 9/2007 Nakanishi
7,953,348 B2 * 5/2011 Chang et al. ..... 399/122

FOREIGN PATENT DOCUMENTS

JP 62-146138 9/1987
JP 8-185076 A 7/1996
JP 2002-296948 A 10/2002
JP 2003-177649 A 6/2003
JP 2006-163381 A 6/2006
JP 2007-079488 A 3/2007
JP 2007-279298 A 10/2007
JP 2007-298691 A 11/2007

OTHER PUBLICATIONS

European Search Report dated Aug. 11, 2010, in related corresponding European Patent Appln. No. 10159130.3.

* cited by examiner

*Primary Examiner* — Hoang Ngo
(74) *Attorney, Agent, or Firm* — Fitzpatrick, Cella, Harper & Scinto

(57) ABSTRACT

An image forming apparatus includes a main assembly, a first openable member openably and closably provided in the main assembly, a second openable member openably and closably provided in the main assembly, and a fixing unit for fixing a toner image formed on a recording material in the main assembly, with the fixing unit including a pressure applying mechanism for applying a pressure to a fixing nip of the fixing unit. In addition, a first arm transmits a first operation force, generated when the first openable member is opened by the operator, to the pressure applying mechanism to release the pressure applied to the fixing nip, and a second arm transmits a second operation force, generated when the second openable member is opened by the operator, to the pressure applying mechanism to release the pressure applied to the fixing nip. The fixing unit is detachably mountable relative to the main assembly and includes a pressure switching member, engaged to the pressure applying mechanism, to receive the first operation force via the first arm when the first openable member is opened and to move the pressure applying mechanism, and the second operation force generated when the second openable member is opened is transmitted to the pressure switching member.

8 Claims, 18 Drawing Sheets

(a)

(b)

(a)

(b)

(a)

(b)

IMAGE FORMING APPARATUS HAVING FIXING UNIT PRESSURE RELEASE

FIELD OF THE INVENTION AND RELATED ART

The present invention relates to an image forming apparatus having a mechanism for removing pressure from the fixation unit of the apparatus.

There are image forming apparatuses which are structured so that the pressure applied to the fixation nip can be removed to make it easier to remove a recording medium having jammed in the adjacencies of the fixation unit in the image forming apparatuses. One of the methods for removing the recording medium having jammed in the adjacencies of the fixation unit is to open a door (rear door) which is on the downstream side of the fixation unit in terms of the direction in which the recording medium is conveyed. In order to keep image formation apparatus cost as low as possible, some image forming apparatuses are not provided with a power source for removing the pressure applied to the fixation nip portion. Some of such image forming apparatuses are structured so that the force applied to the rear door to open it by an operator is utilized to remove the pressure applied to the fixation nip portion, in order to minimize the amount of time and work of which the operator is required.

Further, in the case of some image forming apparatuses structured so that the process cartridges therein, which are expendables, are replaceable, the following situation occurs. That is, as a cartridge or cartridges are removed by opening the cartridge replacement door of the apparatus, the recording medium having jammed in the adjacencies of the fixation nip portion are visible through the opening created by the operating of the door. Thus, it is reasonable to think that the jammed recording medium can be removed by the operator by putting his or her hand into the apparatus through the opening. However, even after the opening of the door, the fixation nip portion remains under a substantial amount of pressure applied for image fixation. Therefore, removing the jammed recording medium is not as easy as it seems.

Thus, it is reasonable to think of structuring an image forming apparatus so that in order to improve an image forming apparatus in usability while keeping the image forming apparatus cost as low as possible, the pressure being applied to the fixation nip portion is removed not only by the opening of the rear door, but also, opening of the cartridge replacement door. One of the image forming apparatuses structured as described above is disclosed in Japanese Laid-open Patent Application 2007-298691.

In the case of an image forming apparatus such as the one disclosed in Japanese Laid-open Patent Application 2007-298691, which is structured so that the pressure being applied to the fixation nip portion can be removed by opening either of the aforementioned two doors, there are two points at which contact is made between the mechanism for applying pressure to the fixation nip portion, and the member to be placed in contact with the mechanism to remove the pressure being applied to the fixation nip portion.

From the standpoint of smooth insertion of a fixation unit into an image forming apparatus, or smooth removal a fixation unit from an image forming apparatus, the greater in the number of the abovementioned points of operational contact, the more disadvantageous is an image forming apparatus structured, in consideration of repair and/or replacement of a fixation unit, so that a fixation unit is removably mountable in the main assembly of the apparatus.

SUMMARY OF THE INVENTION

The present invention was made in consideration of the above described problem, and its primary object is to provide an image forming apparatus which allows a jammed recording medium therein to be easily removed, and is superior in operability in terms of an operation for removing the fixation unit from the main assembly of the apparatus.

According to an aspect of the present invention, there is provided an image forming apparatus comprising a main assembly; a first openable member openably and closably provided in said main assembly; a second openable member openably and closably provided in said main assembly; a fixing unit for fixing a toner image formed on a recording material, said fixing unit including a pressure applying mechanism for applying a pressure to a fixing nip of said fixing unit, wherein an operation force by an operator when at least one of said first openable member and said second openable member is opened by the operator applies to said pressure applying mechanism to release the pressure applied to the fixing nip; wherein said fixing unit is detachably mountable relative to the main assembly and includes a pressure switching member, engaged to said pressure applying mechanism, to receive the operation force when said first openable member is opened and to move said pressure applying mechanism, wherein an operation force when said second openable member is opened is also transmitted to said pressure switching member.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

[Embodiment 1]

Next, the image forming apparatus in the first embodiment of the present invention will be described with reference to the appended drawings.

Figure 1:
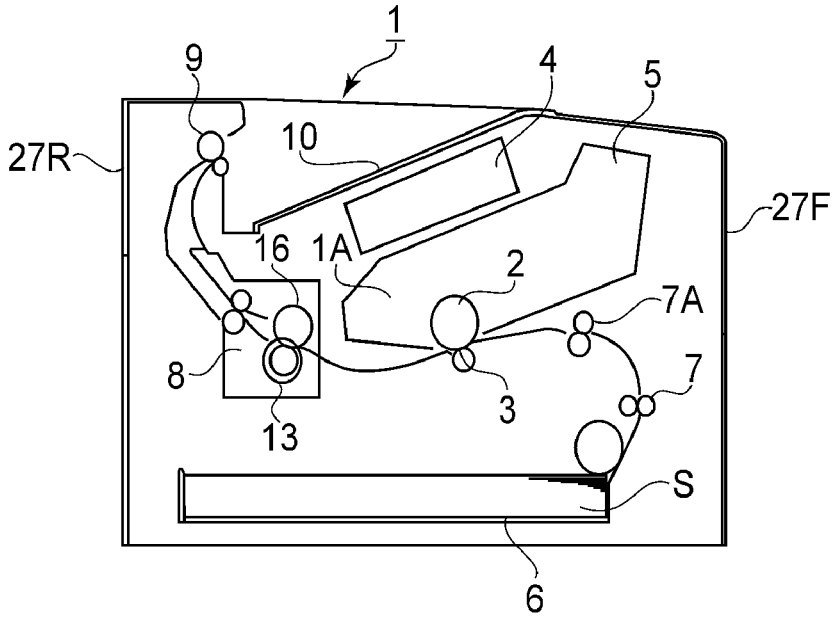
FIG. 1 is a schematic sectional view of an image forming apparatus and shows the general structure of the apparatus.

FIG. 1 is a schematic sectional view of the image forming apparatus in the first embodiment of the present invention, and shows the general structure of the apparatus. Referring to FIG. 1, the main assembly 1 of the image forming apparatus has an image forming portion 1A, a sheet storage cassette 6, a pair of conveyance rollers 7, a pair of registration rollers 7A, a fixing apparatus 8 (fixation unit), a pair of discharge rollers 9, a delivery tray 10, a cartridge replacement door 27F (first member which can be opened or closed: first door), and a door 27R for removal of jammed recording medium (second member which can be opened or closed: second door). The image forming portion 1A has a photosensitive drum 2, a transfer roller 3, a laser scanner 4, and a toner cartridge 5. The door 27R for removal of jammed recording medium in this embodiment doubles as the door for allowing the fixation unit 8 to be mounted into, or removed from, the main assembly 1.

As an image forming operation is started, first, a beam of light is projected upon the peripheral surface of the photosensitive drum 2 by the laser scanner 4 while being modulated with image signals. As a result, a latent image is formed on the peripheral surface of the photosensitive drum 2. This latent image is developed with the toner in the toner cartridge 5 to form a visible image (image formed of toner, which hereafter will be referred to simply as toner image) on the photosensitive drum 2.

Meanwhile, a sheet of recording medium S (which hereafter will be referred to simply as sheet S) is fed into the main assembly 1 from the sheet storage cassette 6, and conveyed by the pair of conveyance rollers 7 and pair of registration rollers 7A to a transfer portion formed by the photosensitive drum 2 and transfer roller 3. As the sheet S is conveyed through the transfer portion, the toner image is transferred onto the sheet S.

After the transfer of the toner image onto the sheet S, the sheet S is conveyed to a fixing apparatus 8, and conveyed through the fixing apparatus 8. As the sheet S is conveyed through the fixing apparatus 8, the toner image on the sheet S is fixed to the sheet S. Thereafter, the sheet S is discharged by the pair of discharge rollers 9 into the delivery tray 10, which is a part of the top wall of the main assembly 1.

In this embodiment, the doors 27F and 27R, that is, the front and rear doors of the main assembly 1, can be opened in the frontward and rearward direction, respectively, of the main assembly 1, and can be rotationally closed in the rearward and frontward direction, respectively, of the main assembly 1. However, the main assembly 1 may be structured so that the doors 27F and 27R can be opened or closed in the leftward or rightward direction of the main assembly 1.

(Fixation Unit)

Figure 2:
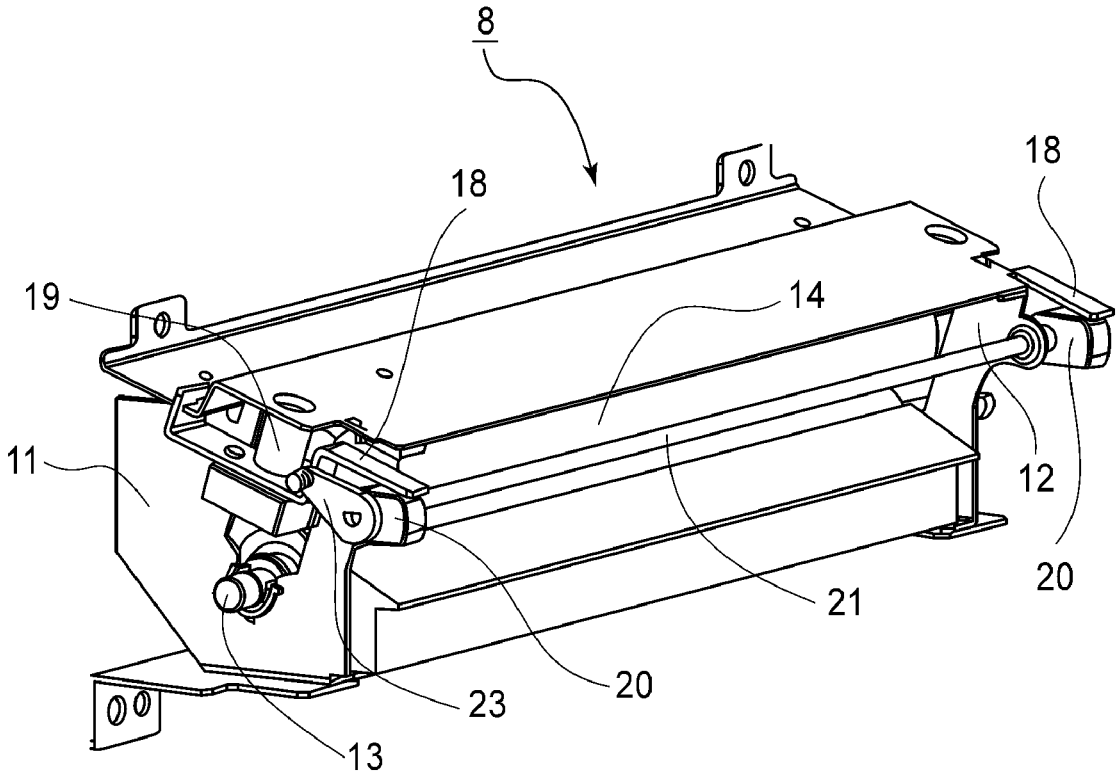
FIG. 2 is a perspective view of the fixation unit in the first embodiment of the present invention.

FIG. 2 is a perspective view of the fixation unit in this embodiment. Referring to FIG. 2, the fixing apparatus 8 is a unit which can be mounted into, or removed from, the main assembly 1. That is, the fixing apparatus 8 can be removed from, or remounted into, the main assembly 1 when it needs to be repaired or in the like situations. The fixing apparatus 8 has a pressure roller 13 (pressure applying member) and a heating unit 14. The pressure roller 13 is held by the left and right lateral plates 11 and 12, respectively, of the frame of the fixing apparatus 8.

Figure 3:
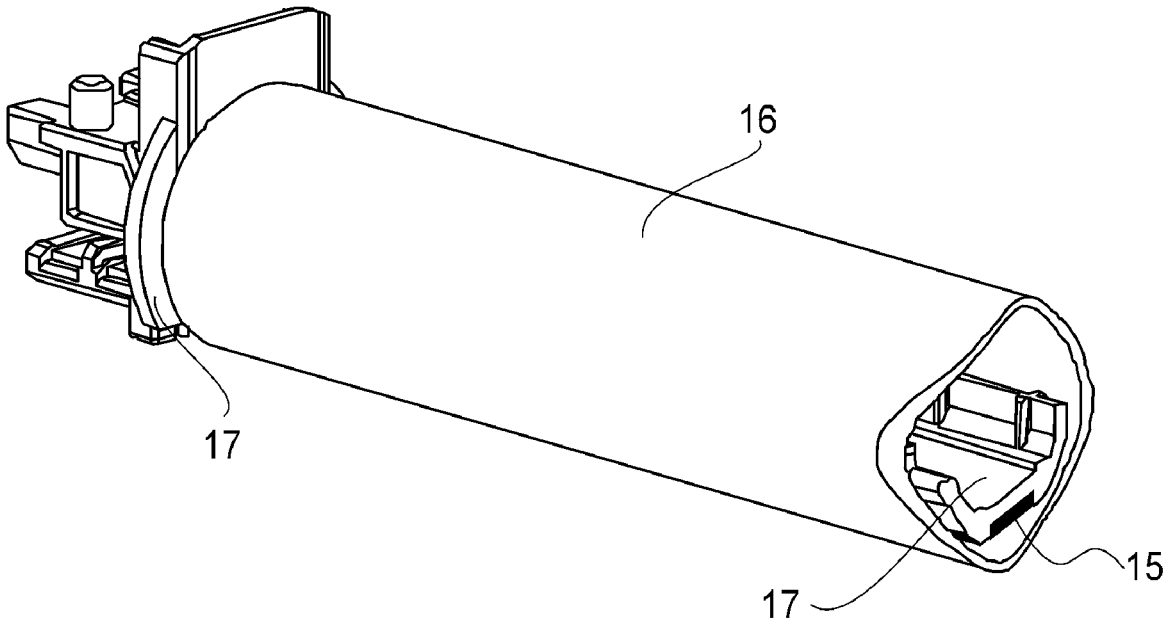
FIG. 3 is a perspective view of the heating unit of the fixation unit in the first embodiment.

Referring to FIG. 3, the heating unit 14 has a heater 15, a fixation film 16, and a film guide 17. The heater 15 is for heating the fixation film 16. The fixation film 16 is cylindrical, and rotates around the heater 15. The film guide 17 holds the heater 15, and also, guides the fixation film 16.

The pressure roller 13 and heating unit 14 form the fixation nip, through which the sheet S is conveyed after the transfer of the toner image onto the sheet S. While the sheet S is conveyed through the fixation nip, heat and pressure is applied to the sheet S and the toner image thereon to thermally fix the toner image.

Figure 4:
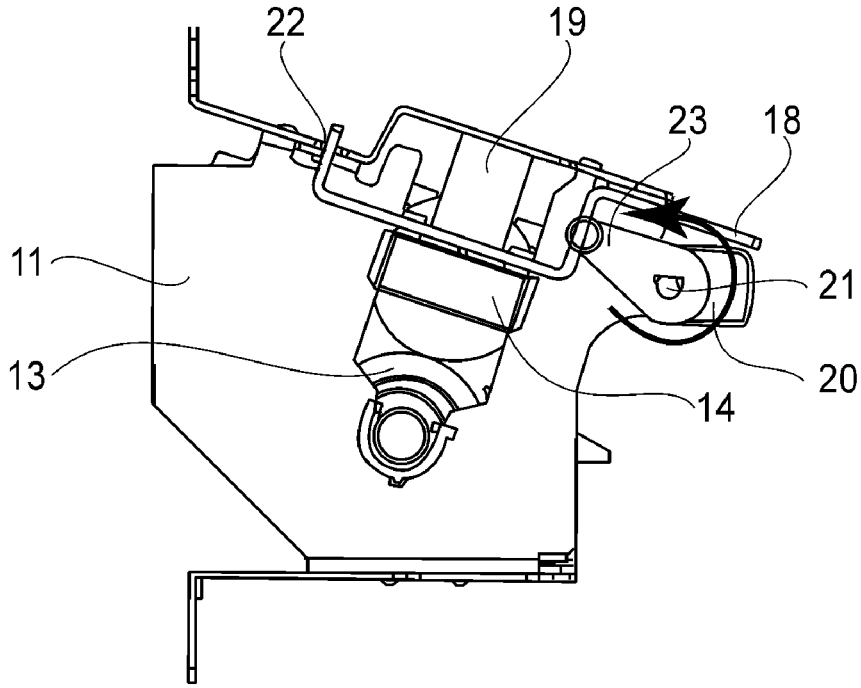
FIG. 4(*a*) is a side view of the fixation unit shown in FIG. 2, which is under pressure (both doors 27F and 27R are remaining closed), and FIG. 4(*b*) is a side view of the fixation unit in FIG. 2, which is not under pressure (at least one of doors 27F and 27R is open).
Figure 4:
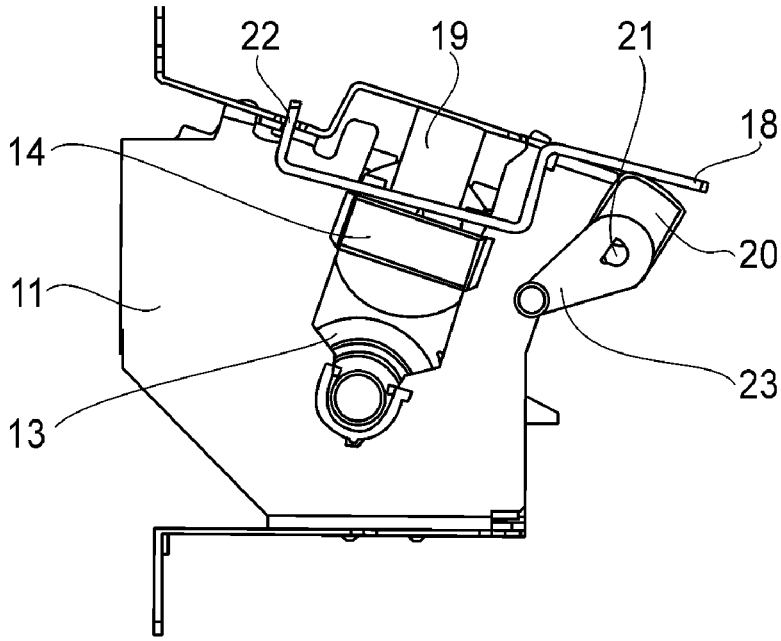

Next, referring to FIG. 4, the fixing apparatus 8 has: a metallic pressure plate 18, which is a part of a pressure application mechanism; a pressure application spring 19 (pressure applying means); and a cam 20 (pressure switching means), which comes into contact with the pressure application mechanism; and a lever 23.

The heating unit 14 is kept pressed upon the pressure roller 13 by the pressure application spring 19, with the presence of the metallic pressure application plate 18 between the heating unit 14 and pressure spring 19. Incidentally, all that is required of the pressure application spring 19 is to keep the heating unit 14 and pressure roller 13 pressured upon the other. Thus, the fixing apparatus 8 may be structured so that the pressure application spring 19 keeps the pressure roller 13 pressed upon the heating unit 14.

There are two cams 20. One cam 20 is at the left end of the heating unit 14, and the other is at the right end of the heating unit 14. They are rotatable about a cam shaft 21, being enabled to be set in the first or second position. The first position (pressure application position in FIG. 4(*a*)) is where it causes the pressure application spring 19 to apply pressure, whereas the second position (pressure removal position in FIG. 4(*b*)) is where it prevents the pressure application spring 19 from applying pressure. When the cams 20 are in the second positions, they keep the metallic pressure application plate 18 lifted.

The metallic pressure application plate 18 is rotatable about its supporting point. As it is lifted by the cams 20, its center portion, which keeps the unit 14 pressed by being pressed by the pressure application spring 19, is lifted away from the unit 14. As a result, pressure is removed from the fixation nip.

The lever 23 is an integral part of the cam 20. Thus, as the lever 23 is pushed down, the cam 20 is rotated (lifted) into its second position, whereas as the lever 23 is pushed up, the cam 20 is rotated back into its first position.

(Connecting Means 25 (Connecting Member), and Mechanical Linkage 29)

Figure 5:
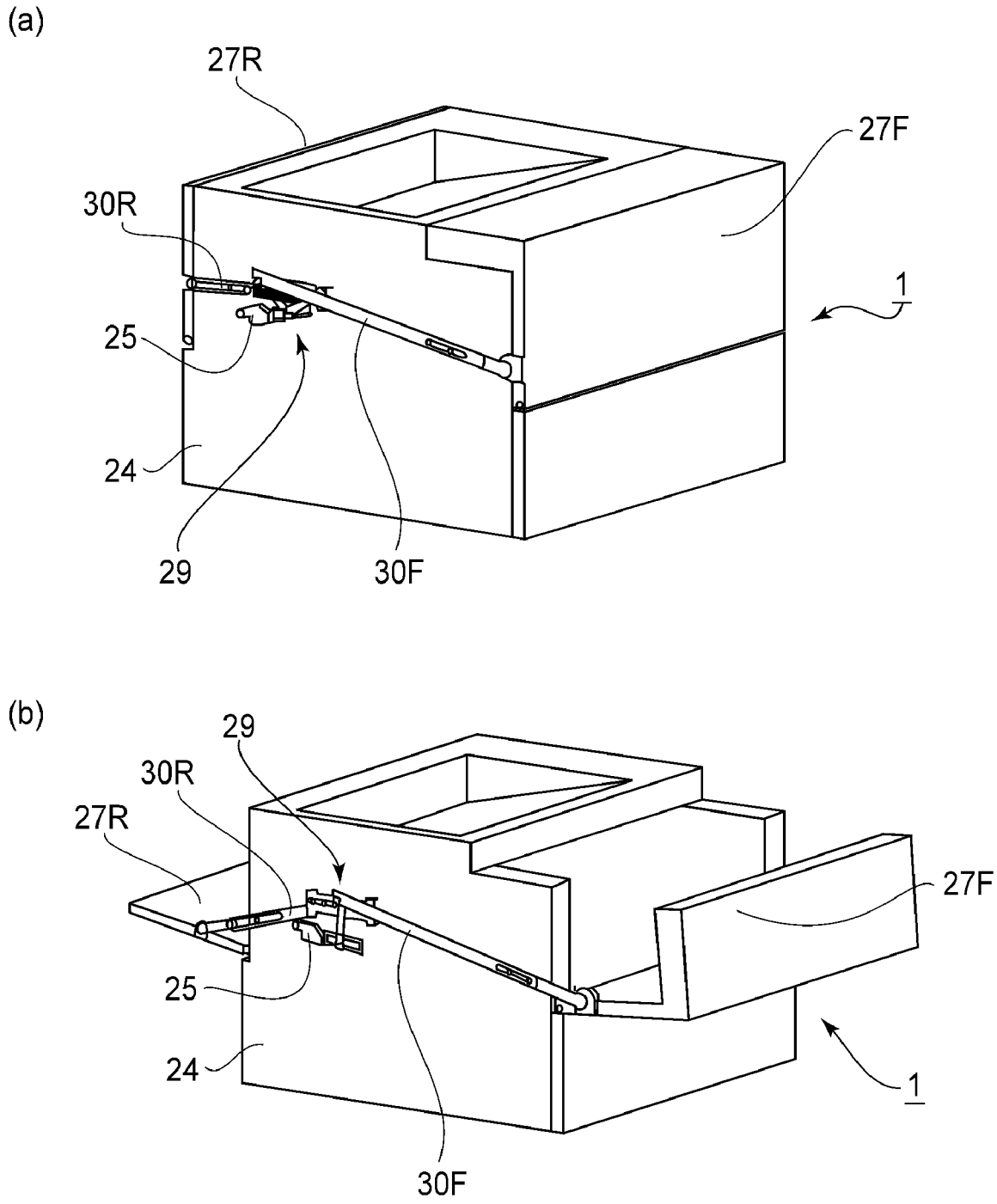
FIGS. 5(*a*) and 5(*b*) are perspective views of the main assembly of the image forming apparatus in the first embodiment, when the doors 27F and 27R of which are open and closed, respectively.
Figure 6:
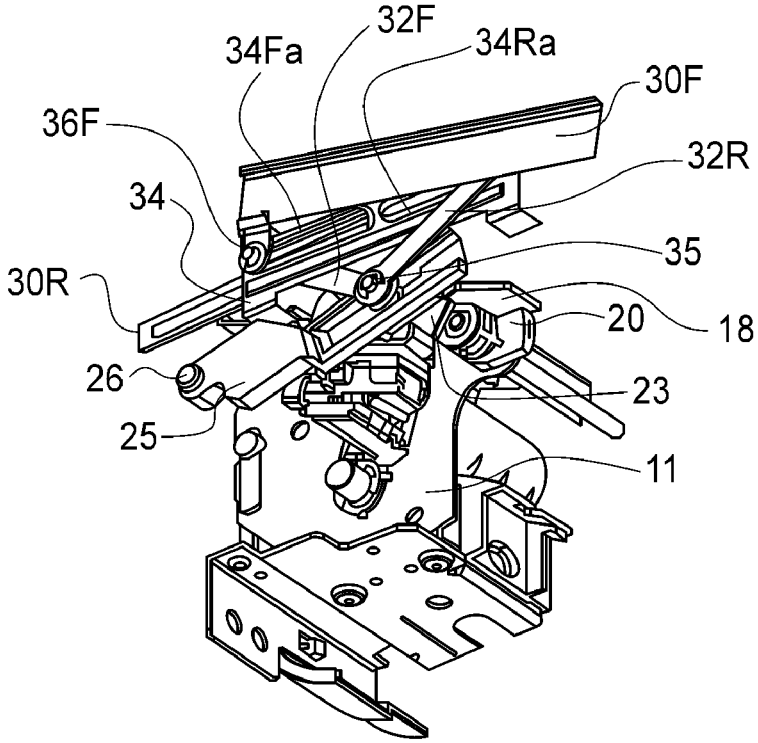
FIGS. 6(*a*) and 6(*b*) are perspective views of the mechanical linkage which acts on the lever 23 shown in FIG. 2, when the fixation unit is under pressure (when doors 27F and 27R are remaining closed), and is not under pressure, respectively.
Figure 6:
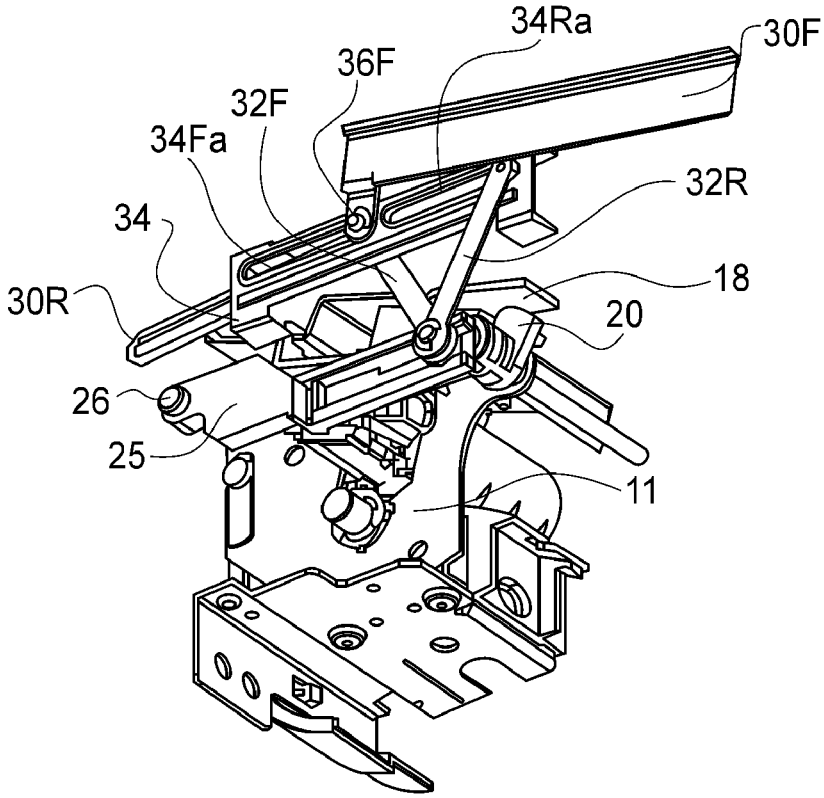

FIGS. 5(*a*) and 5(*b*) are perspective views of the mechanical linkage 29 when the doors 27F and 27R are remaining closed and open, respectively. FIGS. 6(*a*) and 6(*b*) are perspective views of the mechanical linkage 29 when the unit 14 is under pressure (doors 27F and 27R are remaining closed), and not under pressure (only door 27F is open), respectively.

Referring to FIGS. 5 and 6, the main assembly 1 of the image forming apparatus has two sets of connecting means 25 and mechanical linkage 29, which are attached to the left and right lateral plates of the apparatus main assembly 1, one for one. FIGS. 5 and 6 show the connecting means 25 and mechanical linkage 29, which are on the left lateral plate 24.

Each mechanical linkage 29 has an arm 30F (first member), an arm 30R (second member), a link 32F (first link), a link 32R (second link), and a linkage guide 34 (guiding member).

Figure 7:
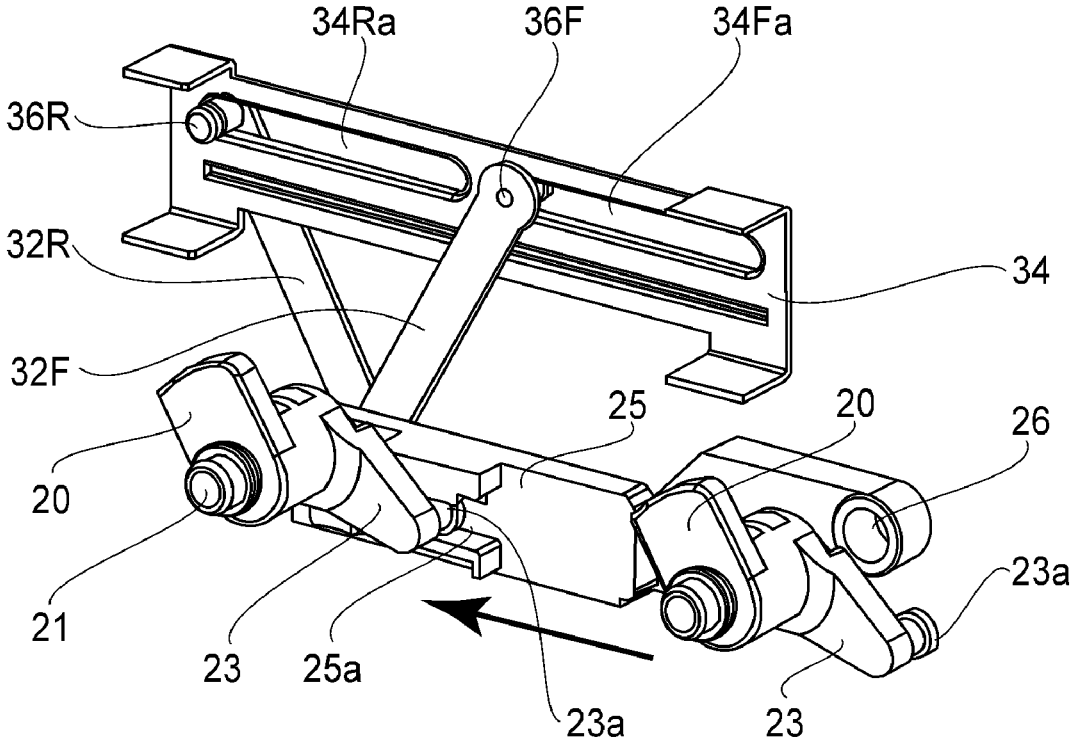
FIG. 7 is a perspective view of the mechanical linkage 29, connective member 25, and pressure switching member 20 of the main assembly of the image forming apparatus, as seen from the inward side of the main assembly.

One end of the arm 30F is in connection with the door 27F, which is the door for mounting or dismounting cartridges. The other end is indirectly in connection the link 32F through a shaft 36F. One of the arms 30R is in connection with the door 27R, which is the door for removing a jammed sheet of recording medium. The other end is indirectly in connection with the link 32R through a shaft 36R (FIG. 7). FIG. 7 is a rear view of the mechanical linkage 29 shown in FIG. 6.

The linkage guide 34 is a stationary member. It is solidly fixed to the frame of the apparatus main assembly 1 so that it does not move relative to the frame. It has two guiding holes 34Fa and 34Ra. The guiding hole 34Fa is elongated in the lengthwise direction of the linkage guide 34, and guides the link 32F (shaft 36F): it allows the link 32F to slidingly move relative to the linkage guide 34 in the lengthwise direction of the linkage guide 34. The guiding hole 34Ra is also elongated in the lengthwise direction of the linkage guide 34, and guides the link 32R (shaft 36R): it allows the link 32R to slidingly move relative to the linkage guide 34 in the lengthwise direction of the linkage guide 34.

The linkage guide 34 holds the links 32F and 32R so that the links 32F and 32R are allowed to move. The links 32F and 32R are connected to each other by the shaft 35 so that they constitute the two sides of a triangle, the bottom side of which is the linkage guide 34, and also, so that they are allowed to rotationally move relative to each other. As the door 27F and/or 27R is opened or closed, the links 32F and 32R are made to slidingly move relative to the linkage guide 34 in such a manner that the abovementioned triangle is changed in height in response to the angle of the doors 27R and/or 27R relative to the apparatus main assembly 1, and the change in the height of the triangle causes the connecting means 25 to rotate about its supporting point 26. The connecting means 25 is a part of the apparatus main assembly 1, and is on the upstream side of the cam 20 in terms of the operational force transmission direction. It is indirectly in connection with the doors 27F and 27L through the mechanical linkage 29, which is moved by the movement of the door 27F and 27R, respectively, as the doors 27F and 27R are moved.

Next, referring to FIG. 7, the connecting means 25 has a U-shaped portion 25*a* (connective portion). The lever 23 has a protrusion 23*a* (connective portion), which is at the opposite end of the lever 23 from the cam shaft 21. As the fixation unit 8 is mounted into the apparatus main assembly 1, the projection 23*a*, which belongs to the fixation unit, is inserted into the U-shaped portion 25*a* of the connecting means 25, which belongs to the apparatus main assembly 1. As a result, the lever 23 becomes connected with the connecting means 25.

As an operator opens the door 27F when the connecting means 25 is in connection with the lever 23, the cartridge door arm 30F moves rightward in FIG. 5 (leftward in FIG. 6). As the arm 30R moves rightward, the shaft 36F of the link 32 is guided rightward by the linkage guide 34 while remaining in the guiding hole 34Fa. As the shaft 36F is guided rightward, the triangle which the links 32R and 32R and linkage guide 34 forms, and the bottom side of which is the linkage guide 34, increases in height. As the triangle increases in height, it presses the connecting means 25 downward, whereby the lever 23 is pressed downward. Thus, the lever 23, which has been in the position (pressure applying position) shown in FIG. 6(*a*), is rotated into the position (pressure removal position) shown in FIG. 6(*b*). Also in a case where only the door 27R is opened, that is, the door 27F is left closed, the connecting means 25 presses down the lever 23 as it does when the door 27F is opened.

When the fixing apparatus 8 is mounted into, or dismounted from, the apparatus main assembly 1, the open side of the U-shaped portion 25*a* is facing the fixing apparatus 8 (lengthwise direction of U-shaped portion 25*a* is parallel to direction in which fixing apparatus 8 is mounted or dismounted). Further, the rotational phase of the cam 20, and that of the lever 23, are set so that when the fixing apparatus 8 is mounted into, or dismounted from, the apparatus main assembly 1, no pressure is applied to the fixation nip (they are as shown in FIG. 6(*b*)).

On the other hand, when the rotational phase of the cam 20 is such that pressure is applied to the fixation nip (it is as shown in FIG. 6(*a*)), the open side of the U-shaped portion 25*a* is facing the opposite direction from the direction in which the fixing apparatus 8 is mounted or dismounted. Thus, it is impossible to mount or dismount the fixing apparatus 8.

As described above, in this embodiment, the apparatus main assembly 1 is structured so that unless the apparatus main assembly 1 is in the state in which the fixation nip is not under pressure, the fixing apparatus 8 in the apparatus main assembly 1 cannot be replaced. Therefore, if the connecting means 25 and lever 23 are not synchronous in rotational phase, they cannot be connected to each other, and therefore, the fixing apparatus 8 cannot be mounted into the apparatus main assembly 1. In other words, the apparatus main assembly 1 is structured so that when the cam 20 of the fixing apparatus 8, door 27F, and/or door 27R are not synchronous in rotational phase, the fixing apparatus 8 cannot be mounted into the apparatus main assembly 1. Further, the apparatus main assembly 1 is structured to ensure that as the fixing apparatus 8 is dismounted from the apparatus main assembly 1, it is placed in the state in which no pressure is applied to the fixation nip. Therefore, even if the fixing apparatus 8 is left unattended for a long time after its removal from the apparatus main assembly 1, the pressure roller 13 and fixation film 16 which form the fixation nip are not deformed.

(Operation of Pressure Switching Member 20, Connecting Means 25, and Mechanical Linkage 29)

FIGS. 8-11 are plan views of the mechanical linkage 29.

Figure 8:
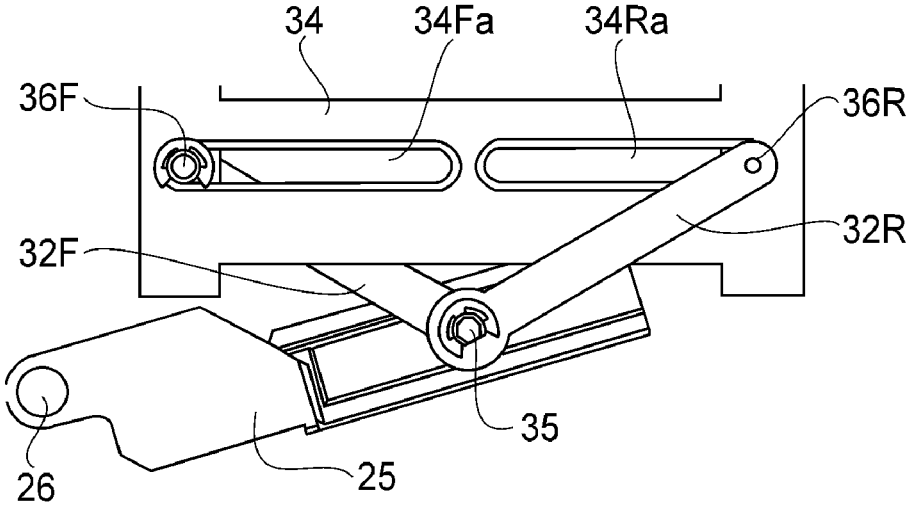
FIG. 8 is a plan view of the mechanical linkage shown in FIG. 6 when the fixation unit is under pressure (both doors 27F and 27R are remaining closed).
Figure 9:
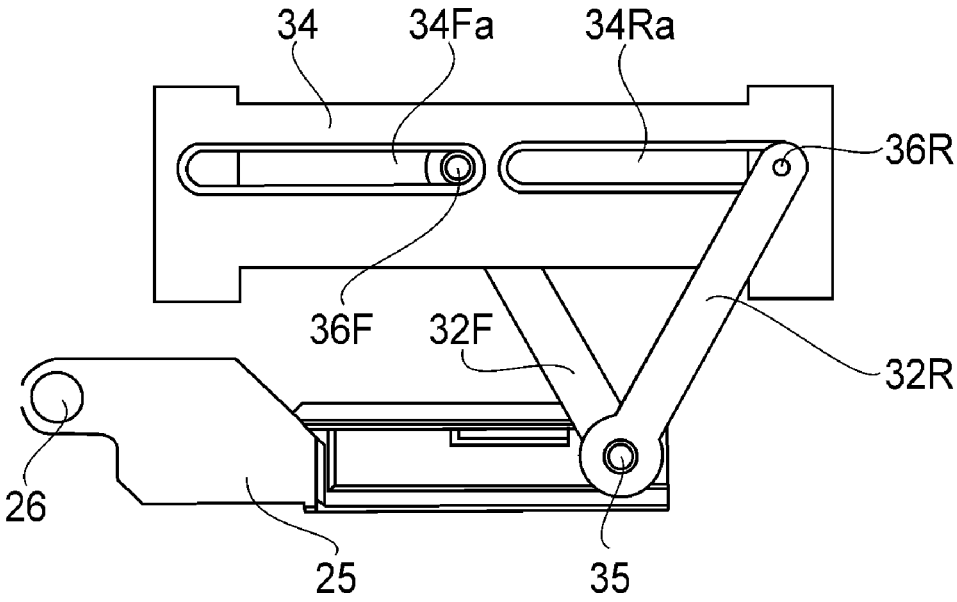
FIG. 9 is a plan view of the mechanical linkage shown in FIG. 6 when the fixation unit is not under pressure (only door 27F is open).
Figure 10:
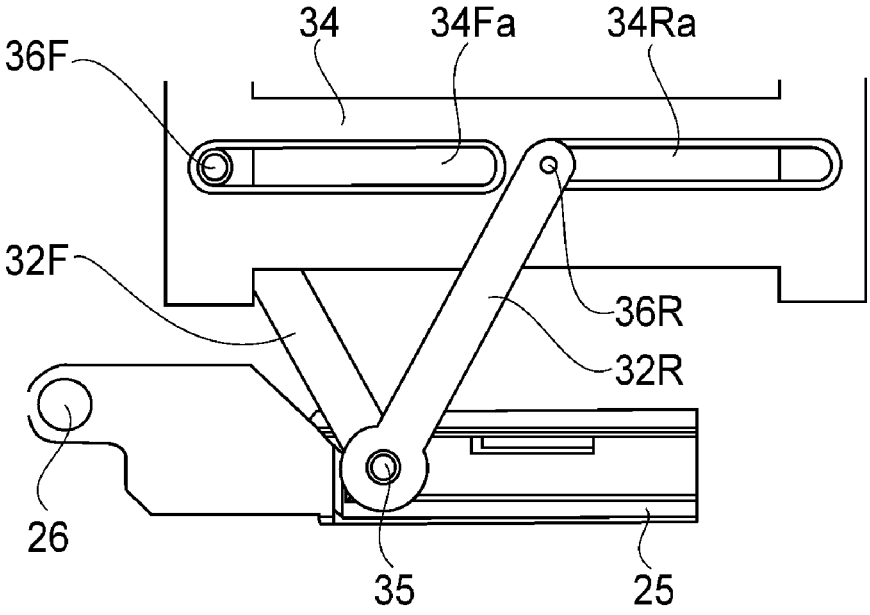
FIG. 10 is a plan view of the mechanical linkage shown in FIG. 6 when the fixation unit is not under pressure (only door 27R is open).

As an operator opens the door 27F when the mechanical linkage 29 is in the state shown in FIG. 8, in which the fixation nip is under pressure (when both first and second door are remaining closed), the link 32F is made to slide along the linkage guide 34 (shaft 36F is guided by guiding hole 34Fa) by opening movement of door) as shown in FIG. 9. As a result, the triangle which the links 34F and 34R, and the link guide 34 which constitutes the bottom side of the triangle, form, increases in height (shaft 35 is moved). Thus, the connecting means 25 is pressed down, being thereby rotated downward about the supporting point 26 (rotational axis).

As the connecting means 25 is rotated about its supporting point 26 into a preset position, the lever 23 and cam 20 are rotated about the cam shaft 21 into their preset points (rotational phases). Consequently, the arcuate portion of the cam 20 comes under the metallic pressure plate 18. Thus, the pressure from the pressure application spring 19 is caught by only the cam 20 and metallic pressure plate 18. Therefore, even when the fixation nip is under no pressure, the mechanical linkage 29 remains under no load.

As the door 27F is closed when the mechanical linkage 29 is in the state shown in FIG. 9, the link 32F slides in the opposite direction from the direction in which it slides when the door 27F is opened. Thus, the connecting means 25 is lifted. Consequently, the fixation nip comes under pressure (state shown in FIG. 8).

The movement of the mechanical linkage 29 which occurs as the rear door 27R is opened is the same as that which occurs as the front door 27F is opened (except that link 32F does not move, and link 32R slides along linkage guide 34: shaft 36R is guided by guiding hole 34Ra). Thus, the fixation nip comes under pressure as shown in FIG. 8.

Figure 11:
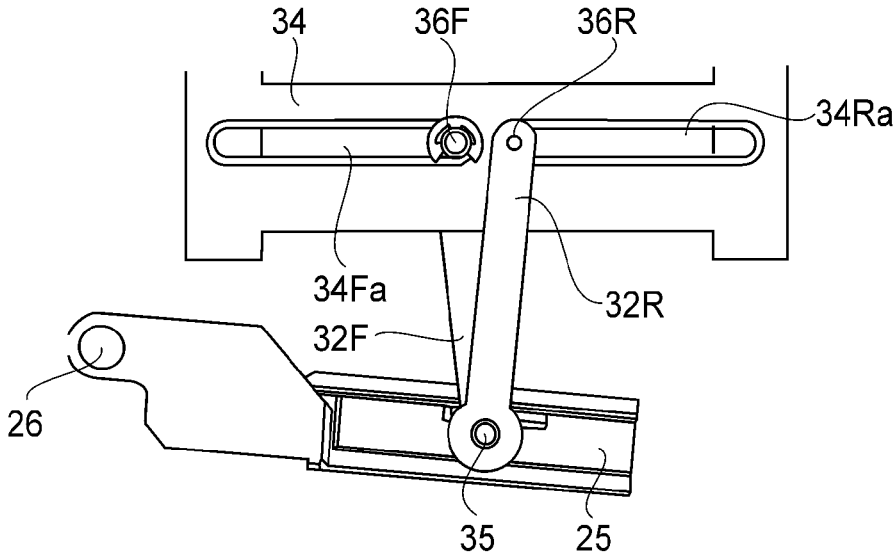
FIG. 11 is a plan view of the mechanical linkage shown in FIG. 6 when the fixation unit is not under pressure (both doors 27F and 27R are open).

In a case where both the doors 27F and 27R are opened, as the doors 27F and 27R are opened, both the links 32F and 32R slide as shown in FIG. 11. Thus, the connecting means 25 is pressed down farther than when only one of the doors 27F and 27R is opened. In this case, therefore, the cam 20 is rotated further, that is, beyond the positions shown in FIGS. 9 and 10. However, the cam 20 is rotated while its arcuate edge portion is remaining in contact with the metallic pressure plate 18. Therefore, the amount of distance by which metallic pressure plate 18 is lifted does not change.

As one of the doors 27F and 27R is closed when both doors are open, the link which is in connection with the door, which is being closed, is made to slide by the movement of the door. As a result, the state of the mechanical linkage 29 changes into the one shown in FIG. 9 or 10. Then, as the other door is closed, the other link is made to slide by the movement of the door. As a result, the state of the mechanical linkage 29 goes back to the one shown in FIG. 8.

The apparatus main assembly 1 in this embodiment is structured as described above. Thus, as the doors 27F and 27R are opened, the mechanical linkage 29 is operated by the opening movement of the doors 27F and 27R in a manner to remove the pressure which is being applied to the fixation nip. Thus, the jammed recording medium or the like can be easily removed. Further, the cam 20 and mechanical linkage 29 can be easily engaged with, or disengaged from, each other by the connecting means 25. Therefore, the fixing apparatus 8 can be easily replaced. Moreover, sensors, motors, etc., are unnecessary. In other words, the present invention can minimize costs.

As described above, the fixation unit 8 is removably mountable in the main assembly 1 of the image forming apparatus. Further, it has the pressure switching member 20 (cam) which is in contact with the pressure application mechanisms (18, 19), and to which the force applied to the door 27F (first member which can be opened or closed) is transmitted to move the pressure application mechanism. Further, the apparatus main assembly 1 is structured so that as the door 27R (second member which can be opened or closed) is opened, the force applied to the door 27R to open it is transmitted to the pressure switching member 20. Further, the apparatus main assembly 1 and fixation unit 8 are structured so that regardless of which of the two doors 27F and 27R (members which can be opened or closed) is opened, it is only to the pressure switching member 20 that the force applied to open the doors is transmitted. Thus, the present invention can improve an image forming apparatus in the operational efficiency with which the fixation unit 8 can be mounted into, or dismounted from, the apparatus main assembly 1.

[Embodiment 2]

Next, referring to FIGS. 12-16, the image forming apparatus in the second embodiment of the present invention will be described. The portions of the image forming apparatus in this embodiment, which are virtually the same as the counterparts in the first embodiment, will be given the same referential codes, and will not be described.

The image forming apparatus in this embodiment is different from that in the first embodiment, in the structure between the mechanical linkage 29 and pressure switching member 50 (cam). In terms of the operation of the mechanical linkage 29, which is caused by the opening or closing of the two doors, this embodiment is the same as the first embodiment. In this embodiment, however, the rear door 27R is dedicated to taking care of the jammed sheets; it is not for mounting or dismounting a fixation unit. In this embodiment, the fixation unit is to be mounted into, or dismounted from, the main assembly 1 of the image forming apparatus, by removing the external cover of the apparatus main assembly 1. Further, in this embodiment, when the fixation unit is mounted or removed, the fixation nip remains under pressure.

Figure 12:
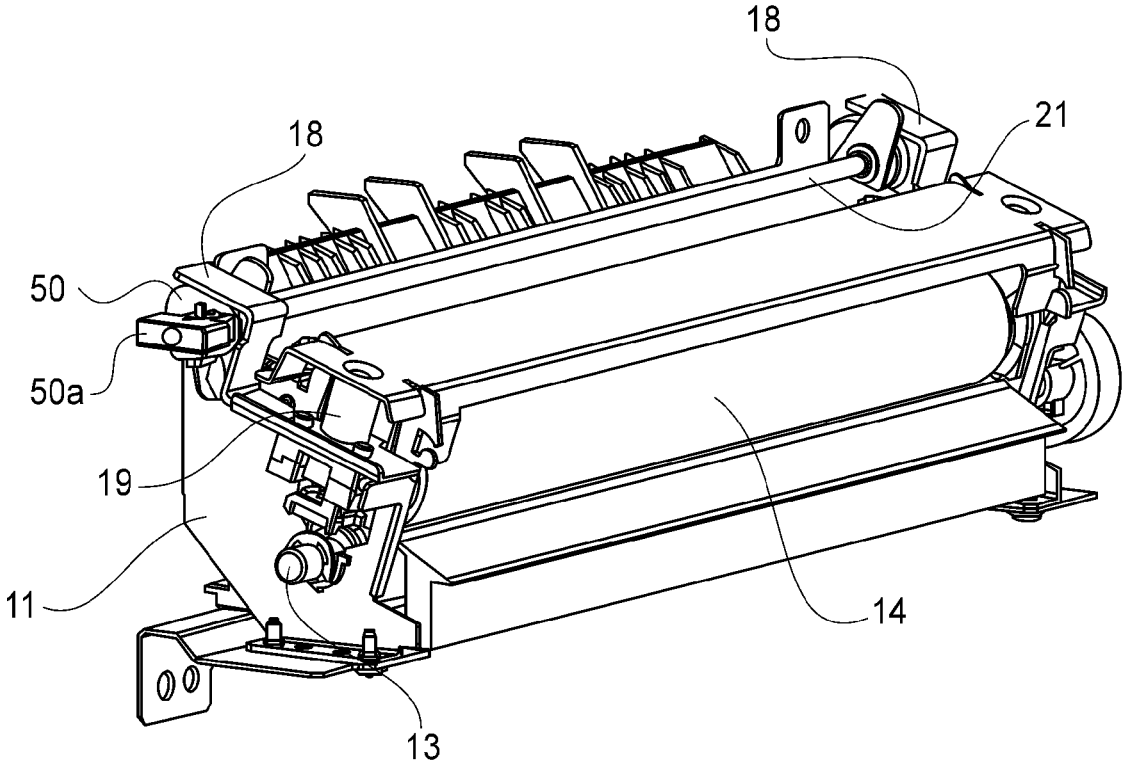
FIG. 12 is a perspective view of the fixation unit in the second embodiment of the present invention.
Figure 13:
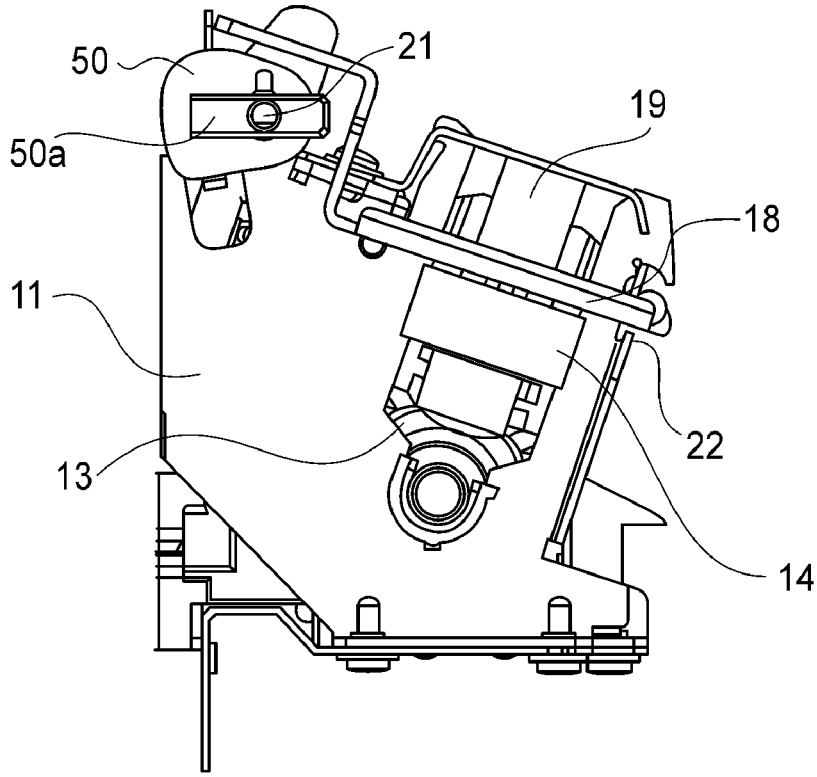
FIG. 13 is a side view of the fixation unit shown in FIG. 12, which is under pressure.
Figure 14:
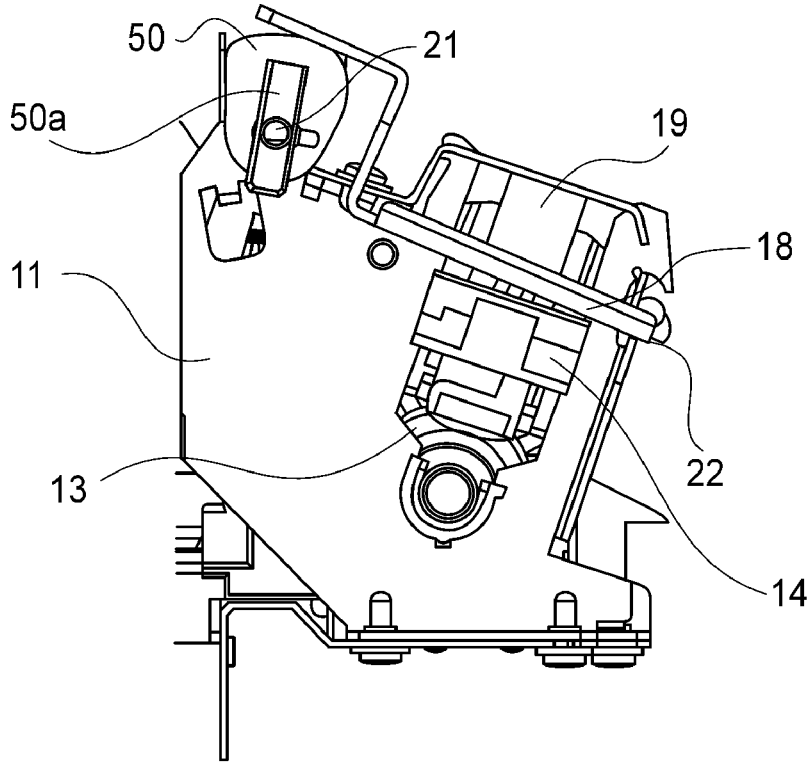
FIG. 14 is a side view of the fixation unit shown in FIG. 12, which is not under pressure.

FIG. 12 is a perspective view of the fixing apparatus 8 in this embodiment. FIG. 13 is a side view of the fixing apparatus 8 when the fixation nip is under pressure. FIG. 14 is a perspective view of the fixing apparatus 8 when the fixation nip is not under pressure.

The metallic pressure plate 18 is rotatable about its supporting point 22. As the end portion of the metallic pressure plate 18 is lifted by a cam 50 when the metallic pressure plate 18 is in the state shown in FIG. 13, that is, when the fixation nip is under pressure, the portion of the metallic pressure plate 18, which is pressing on the heating unit 14, moves upward, whereby pressure is removed from the fixation nip. Consequently, the positional relationship between the metallic pressure plate 18 and heating unit 14 becomes as shown in FIG. 14; the fixation nip is under no pressure. The cam 50 has a key portion 50*a*, which is in the form of a parallelepiped projection. As the cam rotating force is transmitted to the key portion 50*a* from an external source (connecting means), the cam 50 is rotated about the cam shaft 21, whereby the metallic pressure plate 18 is lifted, or allowed to come down.

Figure 15:
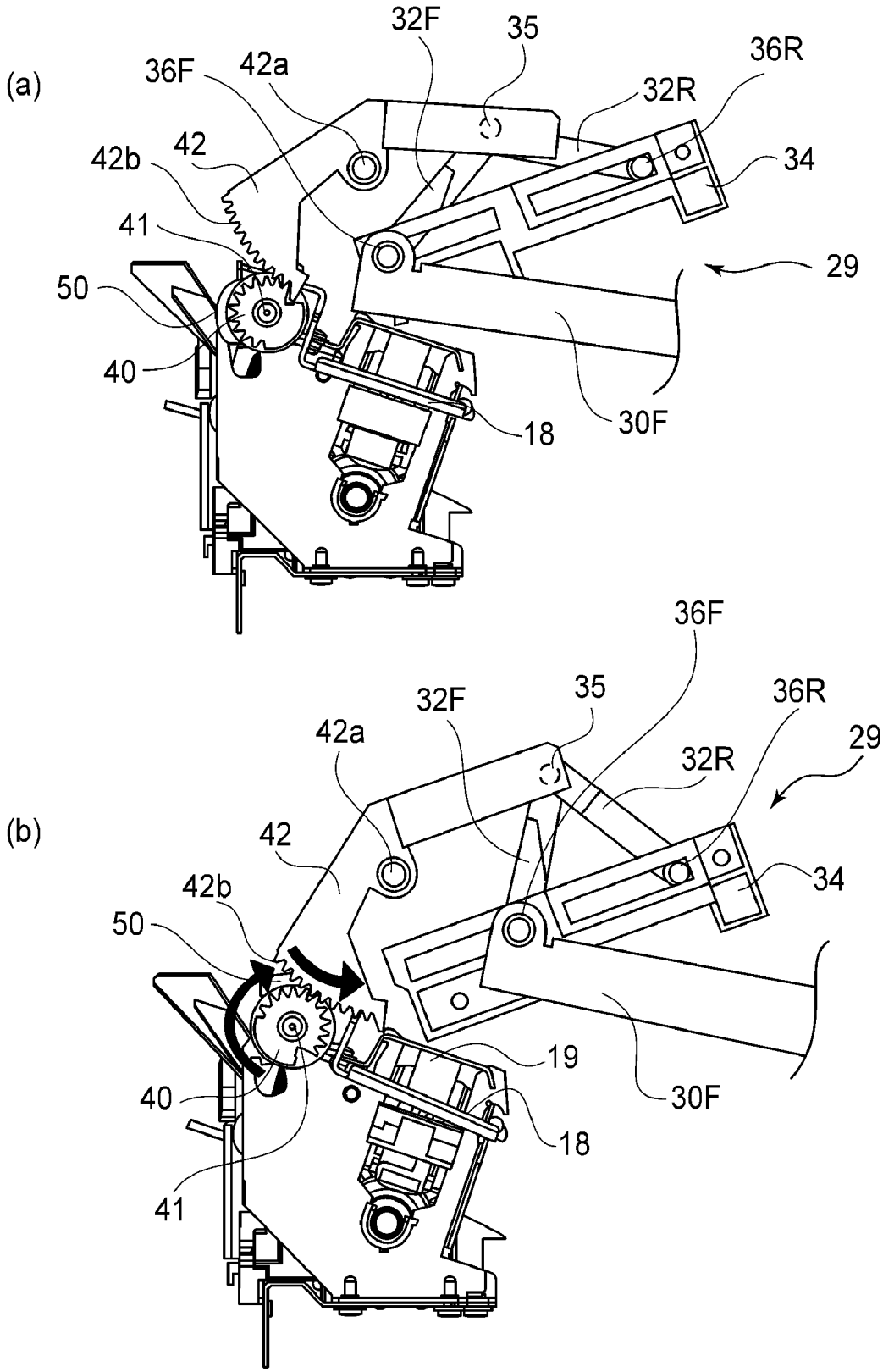
FIGS. 15(*a*) and 15(*b*) are perspective views of the combination of the fixation unit and mechanical linkage shown in FIG. 12, when the fixation unit is under pressure (both doors 27F and 27R are remaining closed), and not under pressure (only door 27F is open), respectively.

FIG. 15(*a*) illustrates the case in which both doors 27F and 27R are remaining closed, and the fixation nip is under pressure. FIG. 15(*b*) illustrates the case in which the door 27F is open and the fixation nip is under pressure. The operation of the mechanical linkage 29 in this embodiment is roughly the same as that of the first embodiment, which was described above with reference to FIGS. 8-11. Thus, the case in which only the door 27F is open, and the case in which both doors 27F and 27R are open, will not be described. FIG. 15 shows only an arm 30F which is in connection with the first door 27F, and a shaft 36F which is in the elongated hole of the linkage guide 34, slides along the linkage guide 34 in response to the movement of the arm which is in connection with the first door, while being guided by the elongated hole. A shaft 36R, which is not shown in FIG. 15, is in the elongated hole of the linkage guide 34, slides along the linkage guide 34 in response to the movement of the arm which is in connection with the second door, while being guided by the elongated hole. Referring to FIG. 15, the role of transmitting rotational driving force to the cam 50 of the fixation unit is performed by a coupling gear (connecting means) with which the main assembly of the image forming apparatus is provided. The coupling gear 40 is fitted around a gear shaft 41 attached to the left lateral plate 24 of the apparatus main assembly 1 by crimping. After the mounting of the fixing apparatus 8 into the apparatus main assembly 1, the rotation axis of the coupling gear 40 coincides with the rotational axis of the shaft on which the cam 50 is. Next, referring to FIG. 16, the force applied to the doors to operate the doors is transmitted to the cam 50 through the connection between the key portion 50*a* of the cam 50 and the U-shape portion 40*a* (connective portion) of the coupling gear 40; the key portion 50*a* is fitted into the U-shaped portion 40.

Referring again to FIG. 15, there is a gear 42 between the mechanical linkage 29 and coupling gear 40. The gear 42 is shaped like a fan, and the operational force is transmitted between the mechanical linkage 29 and coupling gear 40 by way of the fan-shaped gear 42. One of the lengthwise ends of the gear 42 is in the form of a gear portion 42*b*, and the center portion of the gear 42 is provided with an axis 42*a*, about which the gear 42 is rotatable. The gear portion 42*b* meshes with the coupling gear 40. The other lengthwise end of the gear 42 holds a shaft 35 which connect links 32F and 32R. More specifically, it holds the shaft 35 in such a manner that it allows the shaft 35 to slide.

As at least one of the doors 27F and 27R is opened, the movement of the door changes the state of the mechanical linkage 29 from a state, shown in FIG. 15(*a*), in which the fixation nip is under pressure, to a state, shown in FIG. 15(*b*), in which the fixation nip is under no pressure, as it did in the first embodiment. More specifically, as at least one of the doors 27F and 27R is opened, the triangle which the links 32F and 32R, and link guide 34, form, and the bottom side of which is the link guide 34, the opening movement of the door causes the triangle to increase in height, whereby the opposite lengthwise end of the gear 42 from the gear portion 42*a* is pushed up, which in turn causes the gear portion 42*a* of the gear 42 to rotationally move in the direction indicated by an arrow mark in FIG. 15(*b*). This causes the coupling gear 40 to rotate in the direction indicated by another arrow mark in FIG. 15(*b*). Consequently, the pressure which has been on the fixation nip is removed. Incidentally, the linkage guide 34 is a stationary member solidly attached to the main frame of the main assembly 1 of the image forming apparatus, as is the linkage guide in the first embodiment.

Figure 16:
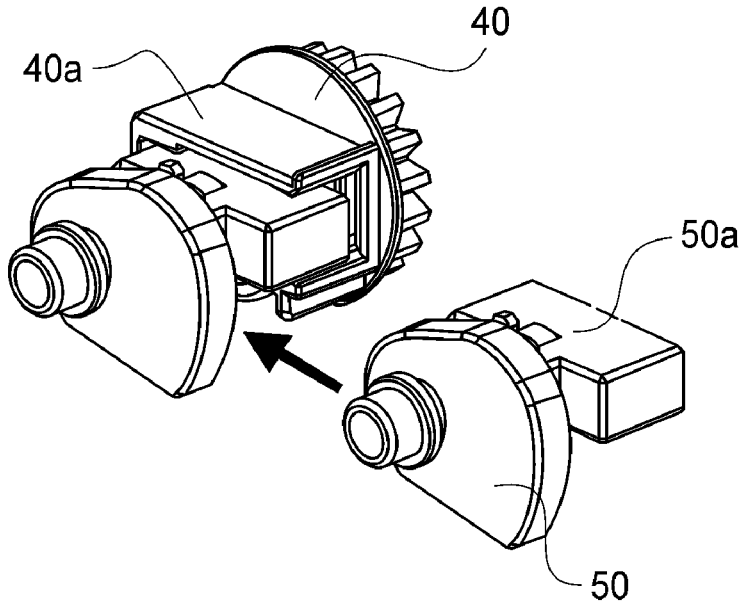
FIG. 16 is a perspective view of the connective member of the main assembly of the image forming apparatus, and the pressure switching member of the fixation unit, and shows how the two members engage with each other as the fixation unit shown in FIG. 12 is mounted into the main assembly of the image forming apparatus.

In this embodiment, the external cover of the main assembly of the image forming apparatus has to be removed in order for the fixation unit to be mounted into, or dismounted from, the main assembly of the image forming apparatus. Referring to FIG. 16, as the fixing apparatus 8 is removed from the apparatus main assembly 1 for such reason as repair or replacing the fixing apparatus 8, the key portion 50*a*, which is a part of the cam 50 of the fixation unit moves in the opposite direction from the direction indicated by the arrow mark in FIG. 16. As a result, the key portion 50*a* comes out of the U-shaped portion 40*a*. In a case where the fixing apparatus 8 is mounted into the apparatus main assembly 1, the key portion 50*a* fits into the U-shaped portion 40*a*.

When the fixing apparatus 8 is mounted or dismounted, the open side of the U-shaped portion 40*a* is facing the direction in which the fixing apparatus 8 is mounted or dismounted (lengthwise direction of U-shaped portion is parallel to direction in which fixing apparatus 8 is mounted or dismounted). Further, the rotational phase of the cam 50 is such that no pressure is applied to the fixation nip.

On the other hand, when the rotational phase of the cam 50 is such that pressure is applied to the fixation nip, the open side of the U-shaped portion 25*a* is facing the opposite direction from the direction in which the fixing apparatus 8 is mounted or dismounted. Thus, it is impossible to mount or dismount the fixing apparatus 8.

As described above, in this embodiment, the fixing apparatus 8 is structured so that unless it is in the state in which the fixation nip is under no pressure, the fixing apparatus 8 in the apparatus main assembly 1 cannot be replaced. Therefore, the fixation nip of the fixing apparatus 8 remains under no pressure after the dismounting of the fixing apparatus 8 from the apparatus main assembly 1. Further, in order to prevent deformations such as creep from occurring because force is continuously applied to the cam 50 for a long time, fixing apparatuses (8) to be used for repair, replacement, and the like purposes are also stored in the state in which the fixing nip is under no pressure.

Incidentally, when the fixation nip is under pressure, the doors 27F and 27R are remaining closed. However, the fixing apparatus 8 is mounted or removed by removing the external cover of the image forming apparatus. Therefore, the application of fixation pressure to the fixation nip, or removal of the fixation pressure from the fixation nip, have nothing to do with the opening or closing of the doors.

The fan-shaped gear 42 is greater in pitch circle than the coupling gear 40. Thus, the angle by which the coupling gear 40 and cam 50 are rotated by the rotational movement of the mechanical linkage 29 and fan-shaped gear 42 is substantially greater than the rotational angle of the mechanical linkage 29 and gear 42. Thus, it is possible to provide the cam 50 with a smooth and curved contact surface for gently lifting the metallic pressure plate 18. In other words, this structural arrangement can reduce in amount the force to which the cam 50 is subjected when the metallic pressure plate 18 is lifted. Thus, this embodiment is advantageous from the standpoint of the durability of the door 27F and 27R in terms of the mechanism involved in the opening or closing of the doors.

The fixation unit in this embodiment is removably mountable in the apparatus main assembly 1 as described above. It has the pressure application mechanism (18 and 19) and the pressure switching member 50 (cam). The pressure switching member 50 is in contact with the pressure application mechanism. The force applied to the door 27F, that is, the first member which can be opened or closed, is transmitted to the pressure switching member 50, the pressure switching member 50 moves the pressure application mechanism. The apparatus main assembly 1 and fixation unit are structured so that the force applied to the door 27R, that is, the second member which can be opened or closed, to open the door 27R, is also transmitted to the pressure switching member 50, that is, the pressure switching member 50 to which the force applied to the door 27F to open the door 27F is applied. In other words, whether the door 27F is operated or door 27R, the force applied to the door 27 to open the door is transmitted to the pressure switching member 50. Thus, this embodiment can improve the operational efficiency with which the fixation unit is mounted into, or dismounted from, the apparatus main assembly 1.

[Embodiment 3]

Next, the third embodiment of the present invention will be described. The third embodiment is a modification of the second embodiment. The third embodiment is different from the second embodiment in that in the third embodiment, while the rear door 27R (door for removing jammed sheet) is moved from its closed position (first position) to an in-between position (second position), the pressure removal cam does not move at all; the cam moves only as the rear door 27R is opened from the in-between position to the fully open position (third position). In other words, in the third embodiment, the pressure removal cam is moved by the movement of the rear door 27R through the latter half of its opening movement range, and it is by this movement of the pressure removal cam that the pressure having been applied to the fixation nip is removed. The second position is set as the position for allowing the recording sheet to be discharged, instead of being set as the position for dealing with the jammed sheet. The components, parts, etc., of the main assembly of the image forming apparatus in this embodiment, and the fixation unit therefor, which are the same in function as the counterparts in the second embodiment, are given the same referential codes as those given to the counterparts in the second embodiment, and will not be described.

Figure 17:
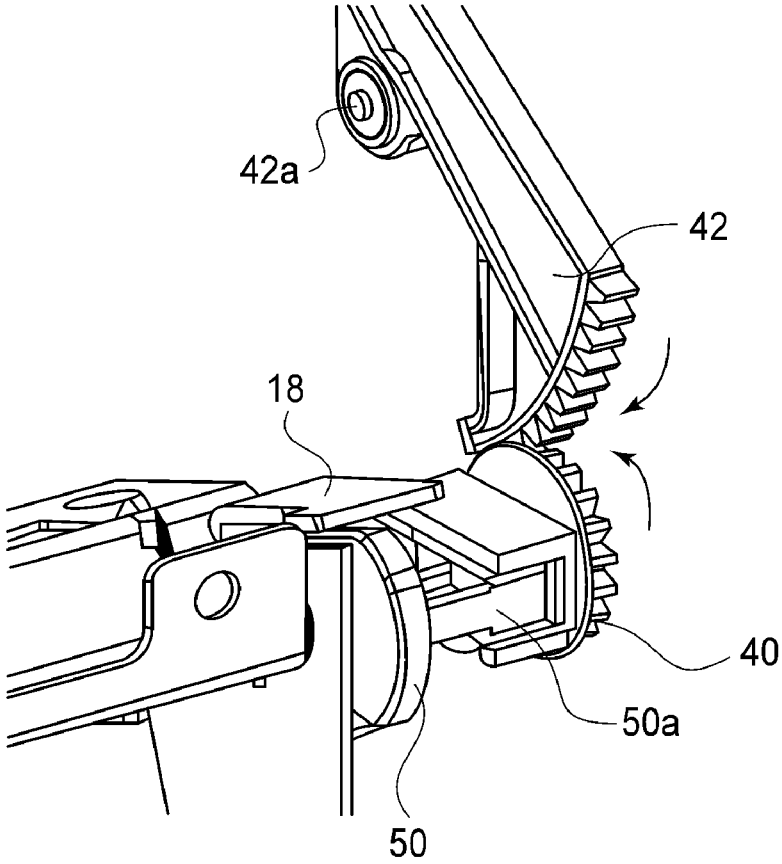
FIG. 17 is a perspective view of the cam (pressure switching member), and its adjacencies, of the fixation unit in the third embodiment of the present invention, and describes how driving force is transmitted to the cam.

FIG. 17 is a drawing for describing the transmission of driving force to the cam 50. Referring to FIG. 17, the cam 50 and coupling gear 40 are coaxial. The coupling gear 40 rotates about the gear shaft 41 (FIG. 15) attached to the apparatus main assembly 1.

The cam 50 has a key portion 50*a* by which the cam 50 receives the force transmitted to the cam 50 to rotate the cam 50 about the cam shaft 21. The coupling gear 40 is in connection with the key portion 50*a* of the cam 50, and transmits to the cam 50 the force for rotating the cam 50. As the cam 50 rotates by receiving the cam rotating force by way of the key portion 50*a*, it lifts the metallic pressure plate 18 or allows the metallic pressure plate 18 to come down.

(Mechanical Linkage)

Figure 18:
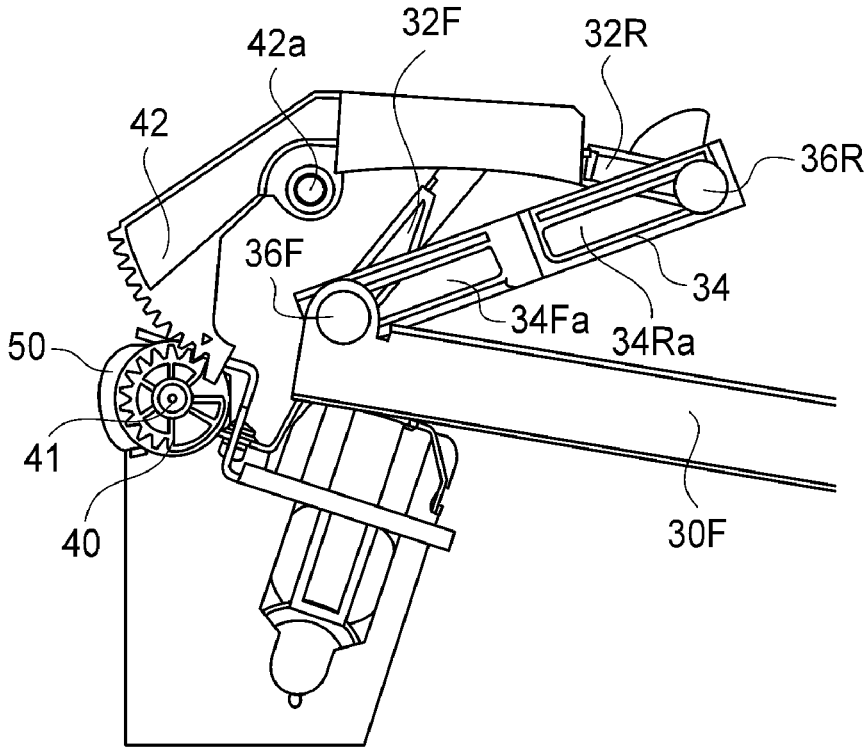
FIG. 18 is a perspective view of the mechanical linkage of the main assembly of the image forming apparatus in the third embodiment of the present invention, and describes the structure of the mechanism.
Figure 19:
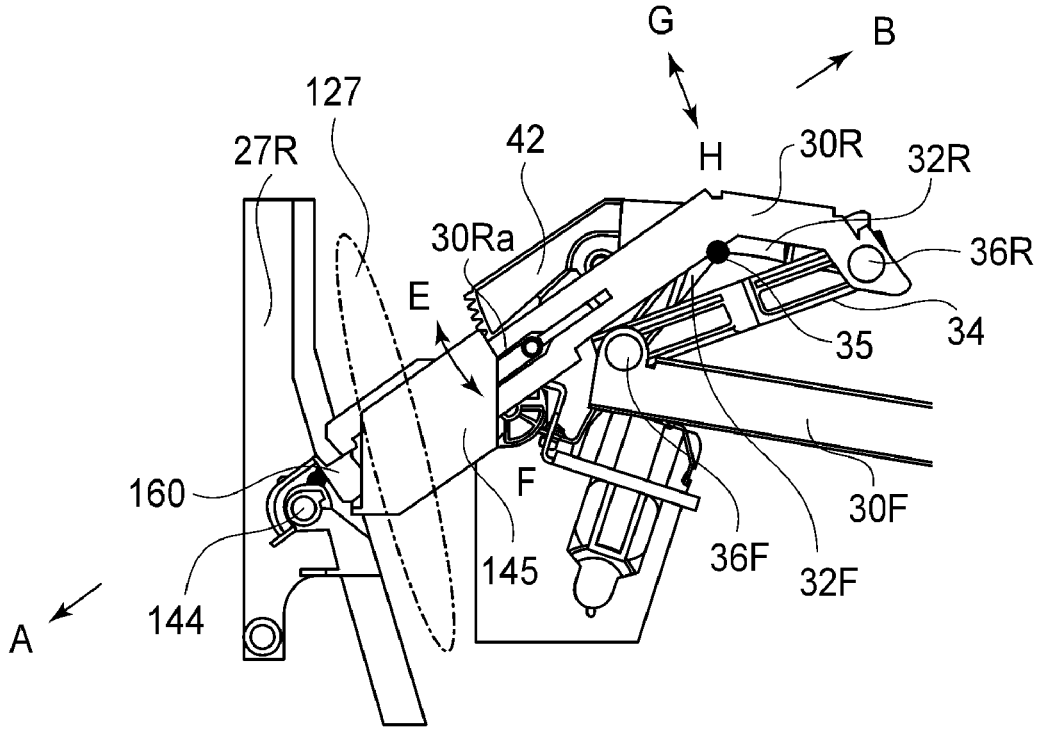
FIG. 19 is a perspective view of the mechanical linkage of the main assembly of the image forming apparatus in the third embodiment of the present invention, when the door 27R is in its first position, and describes the structure of the mechanism.

Next, the mechanical linkage in this embodiment will be described. FIGS. 18 and 19 are drawings for describing the structure of the mechanical linkage. Referring to FIGS. 18 and 19, the mechanical linkage has an arm 30F (connected to door for mounting or dismounting cartridge), an arm 30R (connected to door for removing jammed sheets), a link 32F, a link 32R, a link guide 34, and a link 160 which connects the arm 30R and door 27R.

One end of the arm 30F is connected with one end of the link 32R, with the shaft 35. The links 32F and 32R are rotationally movable relative to each other. The other end of the link 32F is provided with a shaft 36F, whereas the other end of the link 32R is provided with a shaft 36R. One end of the arm 30R is in connection with the shaft 36R of the link 32R. The shafts 36F and 36R are in a guiding groove 34Ra of the link guide 34, and are allowed to slide along the link guide 34 while remaining in the guiding groove 34Ra.

The above described portions of the structure of the image forming apparatus in this embodiment are the same as the counterparts in the second embodiment. Next, the portions of the structure of the image forming apparatus in this embodiment, which are different from the counterparts in the second embodiment, will be described.

Figure 20:
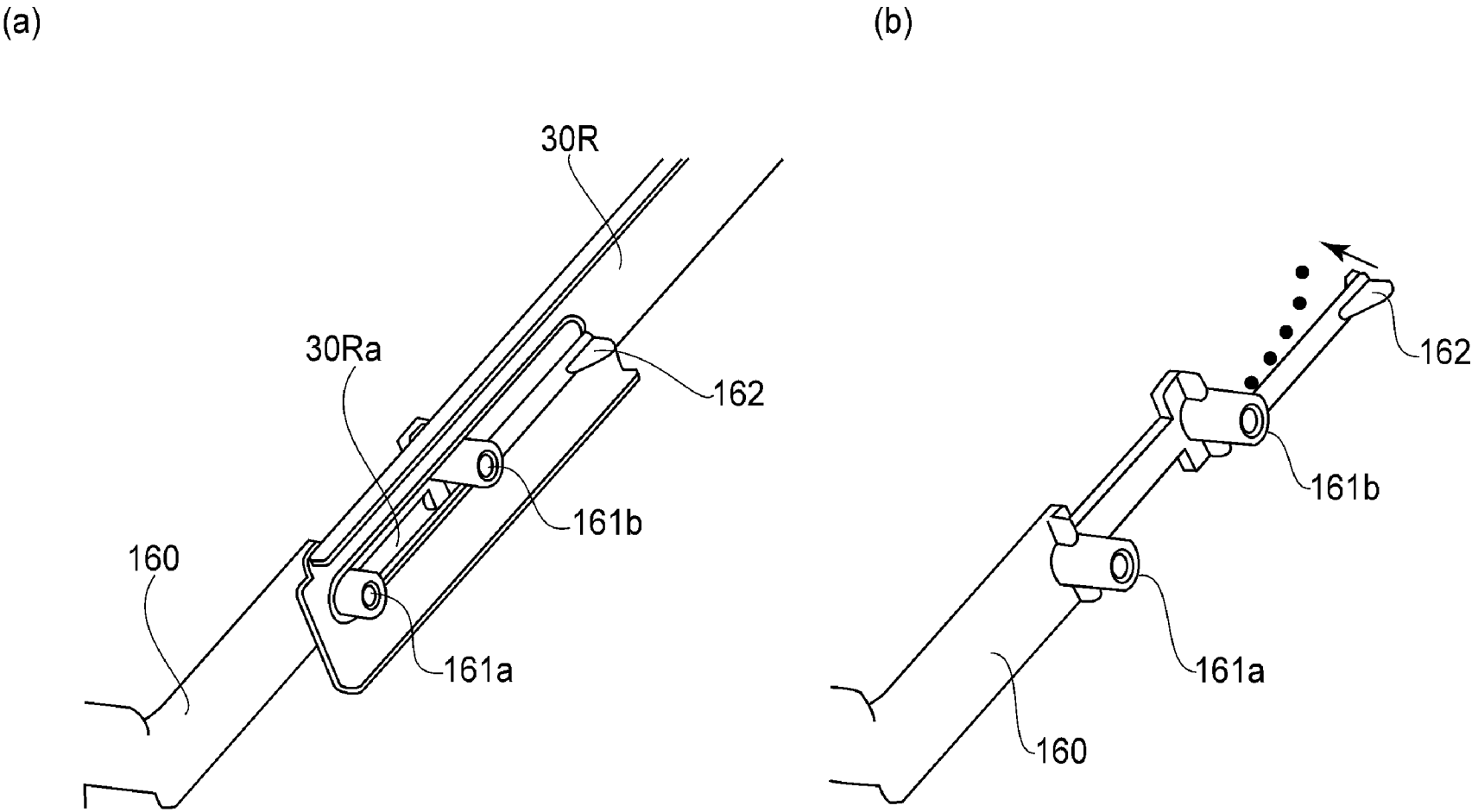
FIG. 20(*a*) is a perspective view of the combination of the arm 30R and linkage 160 shown in FIGS. 19, and 20(*b*) is a perspective view of the linkage 160 shown in FIG. 20(*a*).

The other end of the arm 30R is fitted with the link 160 so that they are allowed to slidingly move relative to each other. The arm 30R and link 160 constitute a shaft which is allowed to extend or shrink. The link 160 is in connection with the door 27R, which is rotatable about its supporting point 144. FIG. 20(*a*) is a drawing which shows the positional relationship between the link 160 and arm 30R. FIG. 20(*b*) is a drawing which shows the structure of the link 160. Referring to FIG. 20, the link 160 has two bosses 161*a* and 161*b* (projections), which are on the mid portion of the link 160 in terms of the lengthwise direction of the link 160. It has also a claw 162 (regulating portion), which is on the tip of the link 161. The bosses 161*a* and 161*b* are in the guiding groove 30Ra of the arm 30R so that the link 160 and arm 30R are allowed to slidingly move relative to each other while being guided by the bosses 161*a* and 161*b* and the guiding groove 30Ra.

Referring to FIG. 20(*b*), the claw 162 of the link 160 (portion of link 160, which has claw 162) is bendable in the direction indicated by an arrow mark (as indicated by dotted line in FIG. 20(*b*)). Next, referring to FIG. 19, the guiding member 145 guides the link 160 and arm 30R while they slidingly move relatively each other. Further, the guide 145 prevents the link 160 and arm 30R from becoming disengaged from each other.

(Operation of Mechanical Linkage During Opening of Jammed Recording Medium Removal Door 27R)

(First Position)

Figure 21:
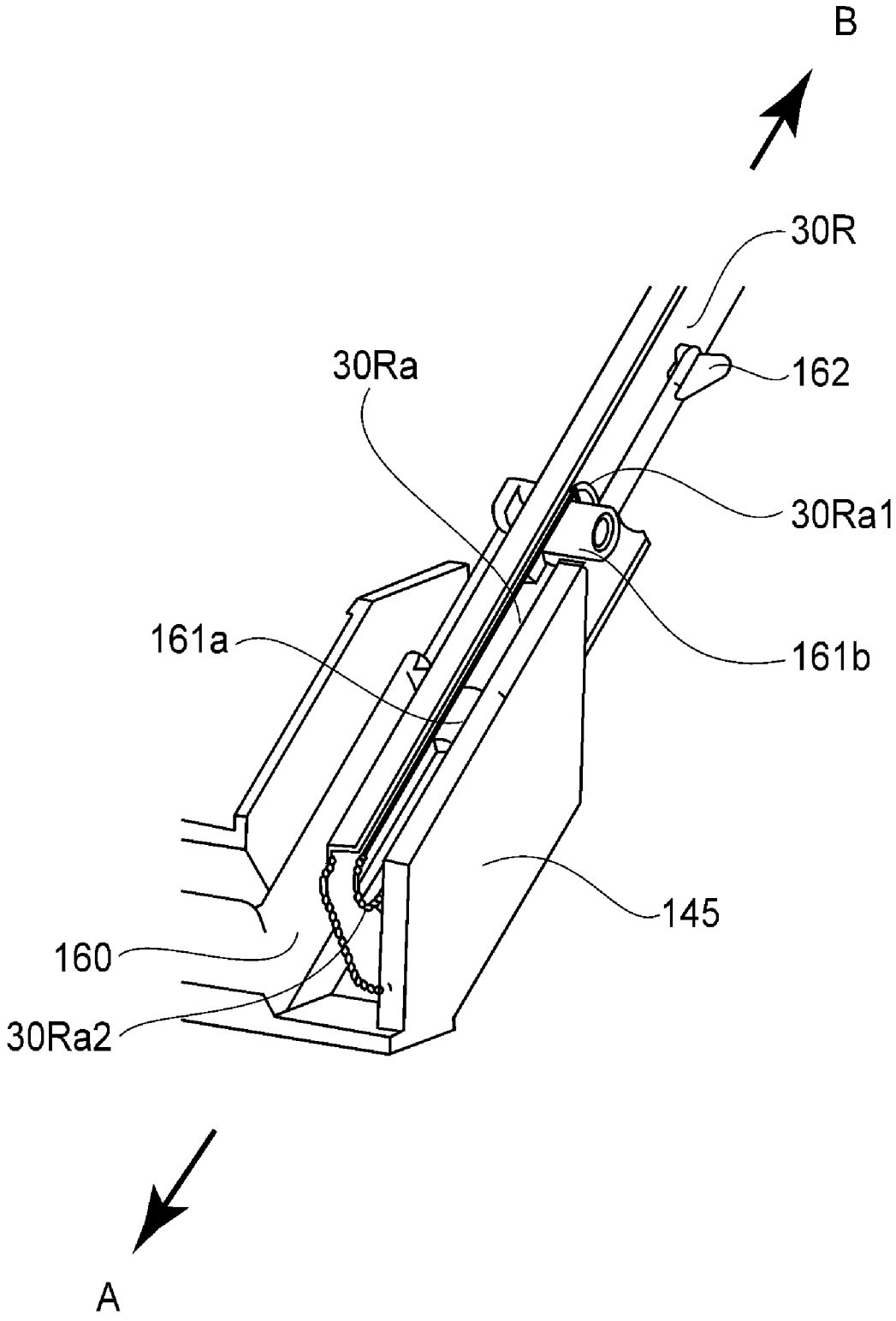
FIG. 21 is a perspective view of the combination of the door 27R, arm 30R (which connects door 27R and linkage 160), and linkage 160 shown in FIG. 19, when the door 27R is in its first position, and describes the structure of the combination.

FIGS. 19 and 21 are drawings which show the mechanical linkage, arm 30R, and link 160 while the door 27R is remaining closed (door 27R is in first position).

Referring to FIG. 19, while the door 27R is remaining closed (in first position), the door 27R serves as a part of the walls of a recording sheet conveyance passage 127. The recording sheet is conveyed through its conveyance passage 127, and is discharged into a delivery portion 10 (FIG. 1) in which recording sheets are layered. The delivery portion 10 is a part of the top wall of the image forming apparatus.

Next, referring to FIG. 20, the link 160 is in the position into which it has slidingly moved relative to the arm 30R in the direction indicated by the arrow mark B (closing direction of door 27R). The boss 161*b* is at the lengthwise end 30Ra1 (in terms of direction indicated by arrow B) of the guiding groove 30Ra.

While the link 160 and arm 30R are in the state shown in FIG. 21, the image forming apparatus can perform the normal printing operation, and the fixation nip is under pressure.

(Second Position)

Figure 22:
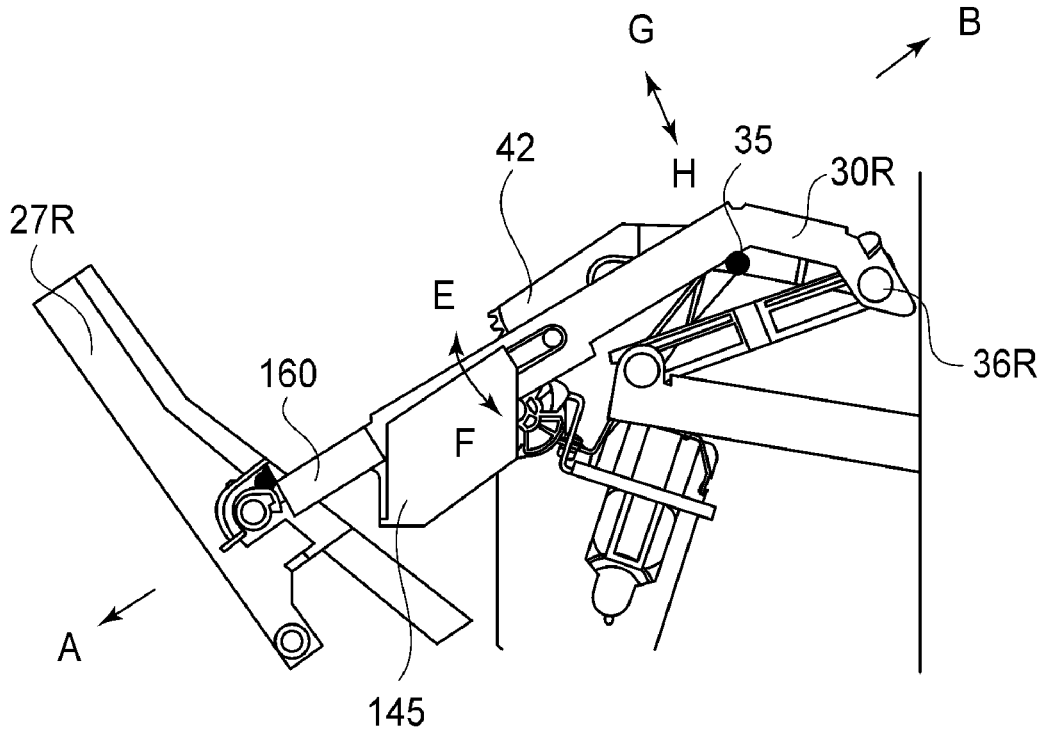
FIG. 22 is a perspective view of the mechanical linkage, and its adjacencies, when the door 27R shown in FIG. 17 is in its second position, and describes the structure of the linkage.
Figure 23:
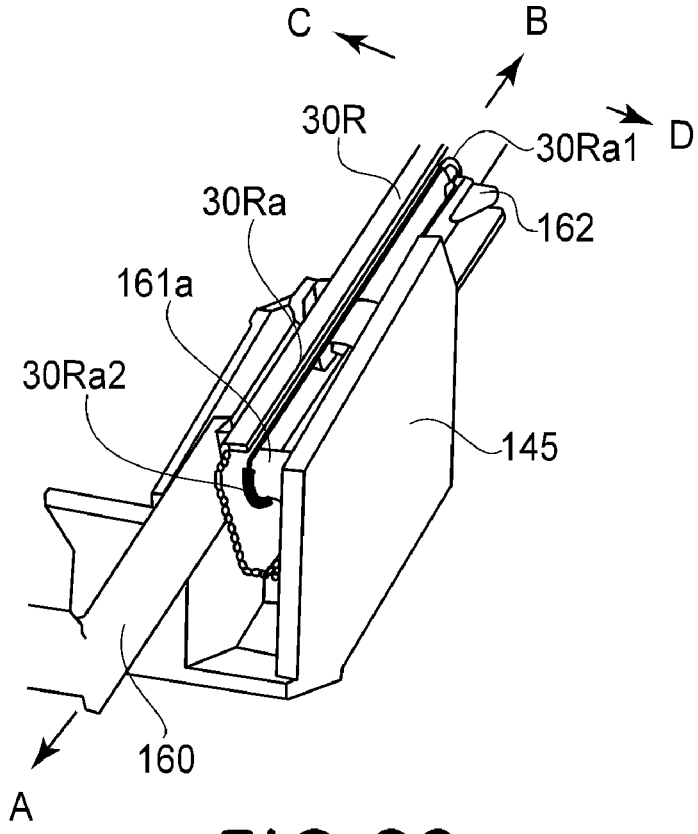
FIG. 23 is a perspective view of the combination of the arm 30R, linkage 160, and their adjacencies, when the door 27R shown in FIG. 19 is in its second position, and describes the structure of the combination.

FIGS. 22 and 23 are drawings which show the states in which the mechanical linkage 29, arm 30R, and link 16 are, respectively, when the door 27R is open (second position).

Referring to FIG. 22, when the door 27R is open (in second position), it serves as a face-up delivery tray (FU tray) in which sheets S are layered as they are discharged from the apparatus main assembly 1. When the door 27R is in the second position, the recording sheet conveyance passage is shorter and less winding than when the door 27R is in the first position. Thus, when the door 27R is in the second position, the recording sheet conveyance passage can convey even a sheet of recording medium such as a sheet of cardboard.

Next, referring to FIG. 23, when the door 27R is in the second position, the link 160 has slid in the direction indicated by an arrow mark A (opening direction of door 27R): the combination of the link 160 and arm 30R is in the extended state. The boss 161*a* is at the other end 30Ra2 (end in direction indicated by arrow mark A) of the guiding groove 30Ra.

(First Position⇔Second Position)

Referring again to FIG. 22, while the door 27R is opened from the first position to the second position, the link 160 is slidingly moved in the arrow mark A direction by the rotational movement of the door 27R. Next, referring to FIG. 23, as the link 160 is slidingly moved, the bosses 161*a* and 161*b* slidingly move in the guiding groove 30Ra in the arrow mark A direction. During this action, the arm 30R is subjected to no force, and therefore, it does not slide. Thus, the fan-shaped gear 42, key portion 50*a*, and cam 50 do not move. Consequently, the fixation nip remains under pressure. When the image forming apparatus 1 is in this state, it can perform the normal printing operation.

Next, referring to FIG. 23, as the door 27R is closed, that is, as the door 27R is rotationally moved from the second position to the first position, the bosses 161*a* and 161*b* slidingly move in the guiding groove 30Ra in the arrow B direction. During this action, the arm 30R does not slide, and the fan-shaped gear 42, key portion 50*a*, and cam 50 do not move. Thus, the fixation nip remains under pressure.

(Third Position)

Figure 24:
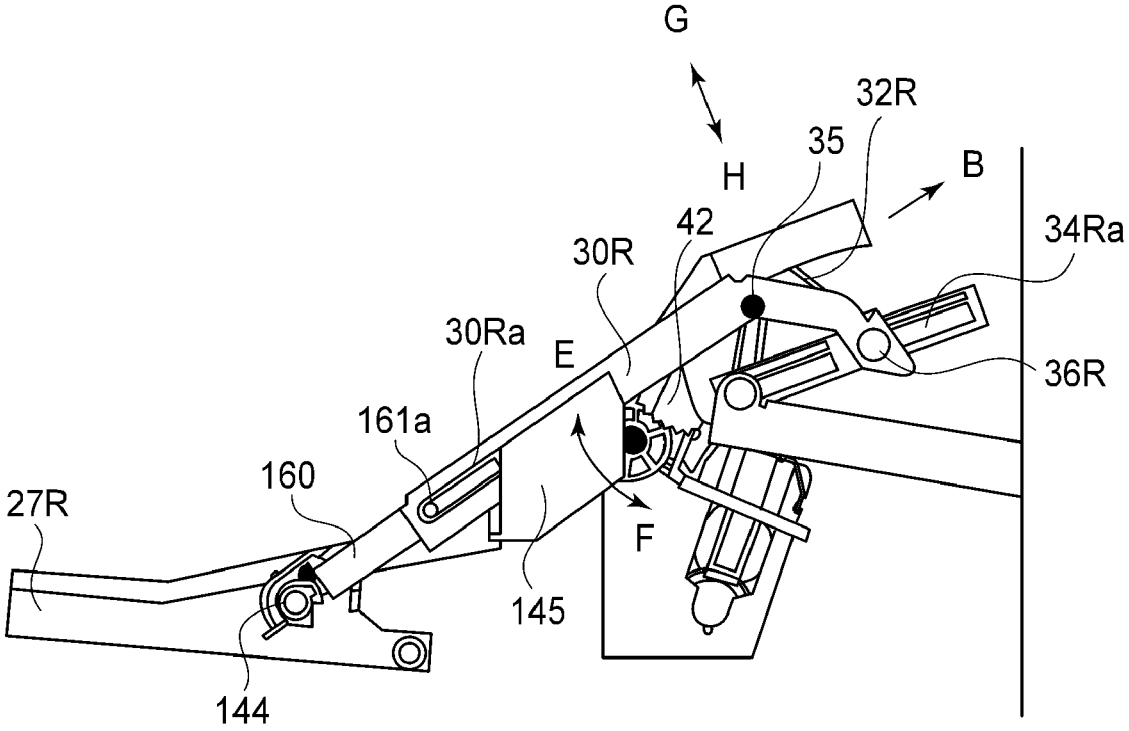
FIG. 24 is a perspective view of the mechanical linkage when the door 27R shown in FIG. 19 is in its third position, and describes the structure of the linkage.
Figure 25:
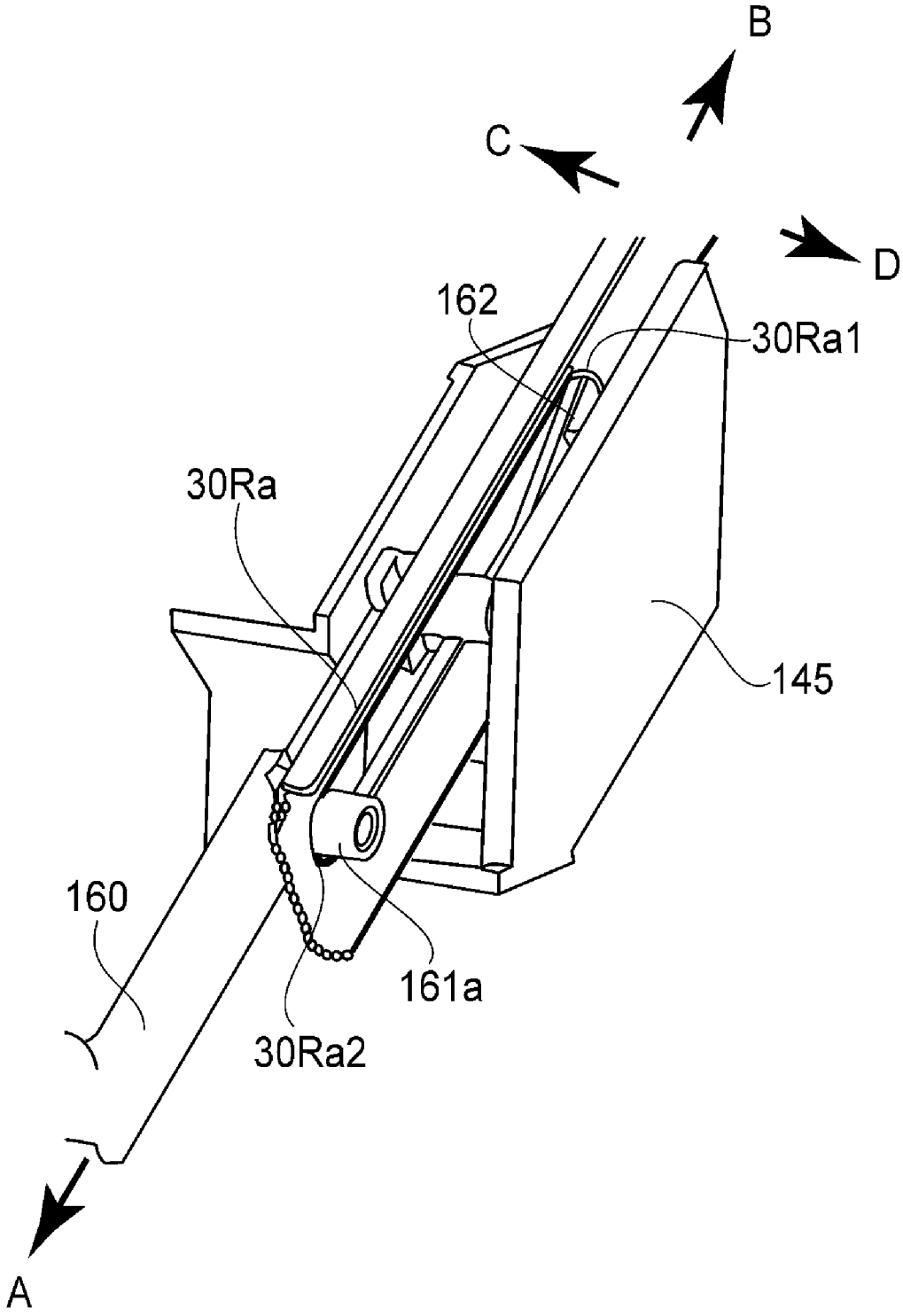
FIG. 25 is a perspective view of the combination of the arm 30R, linkage 160, and their adjacencies, when the door 27R shown in FIG. 19 is in its third position, and describes the structure of the combination.

FIGS. 24 and 25 are drawings which show the mechanical linkage, arm 30R, and link 160 which are in the state in which the door 27R is in its third position (in which door 27R is open wider than when it is in second position).

Referring to FIG. 24, when the door 27R is in the third position (in which it is open wider than when it is in second position), the shaft 36R has slid in the guiding groove 34Ra in the arrow A direction, and the arm 30R has moved in the arrow A direction. That is, the door 27R has been opened as far as where it allows the jammed sheet to be removed: the space for removing the jammed sheet has been increased in size.

Next, referring to FIG. 25, the door 27R is in the third position, the link 160 has slid in the arrow A direction (opening direction of door 27R): the combination of the link 160 and arm 30R is in the extended state. The boss 161*a* is at the other end 30Ra2 (end in arrow A direction) of the guiding groove 30Ra.

(Second Position⇔Third Position)

Referring again to FIG. 24, during the period in which the door 27R is opened from the second position to the third position while the boss 161*a* is remaining in contact with the other end 30Ra2 of the guiding groove 30Ra, the arm R slides in the arrow A direction. As the arm 30R slides, the shaft 36R slides in the guiding groove 34Ra in the arrow A direction. As a result, the shaft 35 is lifted in the direction indicated by an arrow mark G. This upward movement of the shaft 35 causes the fan-shaped gear 42 to rotate about the shaft 42*a*, which in turn causes the coupling gear 40 to rotate. This rotation of the coupling gear 40 causes the cam 50 to rotate by the key portion 50*a*. Thus, the metallic pressure plate 18 is lifted. Consequently, the fixation pressure is removed from the fixation nip. While the image forming apparatus 1 is in this state, it cannot perform the normal printing operation. When the arm 30R is in the position shown in FIG. 25, the claw 162 of the link 106 is the position into which it has been bent as indicated by a dotted line in FIG. 20, by coming into contact with the guiding member 145. Thus, the claw 162 is in the guiding groove 30Ra of the arm 30R.

Next, during the period in which the door 27R is closed, more specifically, during the period in which the door 27R is rotationally moved from the third position to the second first position, the claw 162 moves in the arrow B direction while pushing the end 30Ra1 of the guiding groove 30Ra and while the combination of the link 160 and arm 30R remaining extended (remaining in state in which it cannot be extended or shrunk). This movement of the claw 160 causes the shaft 35 to move downward in the direction indicated by an arrow mark H, which in turn causes the fan-shaped gear 42 to rotate about the shaft 42*a* in the direction indicated by an arrow mark E, causing thereby the coupling gear 40 to rotate. This rotation of the gear 40 causes the cam 50 to rotate, by way of the key portion 50*a*, causing the metallic pressure plate to move downward. Consequently, the fixation unit comes under pressure. Thereafter, the claw 162 separates from the guiding member 145 right before the door 27R moves into the second position. That is, the claw 162 is free from the state into which it was pressed. Consequently, it becomes possible for the bosses 161*a* and 161*b* to move in the guiding groove 30Ra. That is, it is possible for the link 160 to move relative to the arm 30R in the direction to cause the combination of the link 160 and arm 30R to shrink.

[Embodiment 4]

Figure 26:
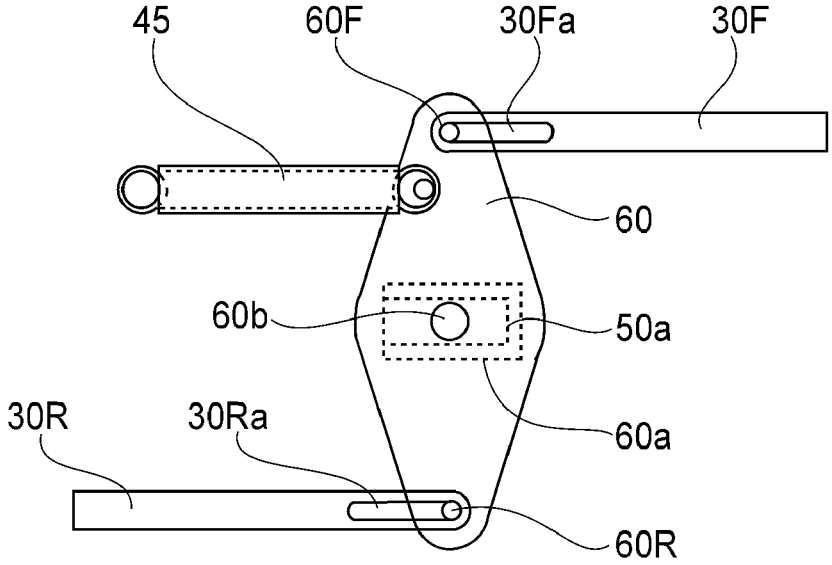
FIG. 26 is a plan view of the mechanical linkage in the fourth embodiment of the present invention when the fixation unit is under pressure (both doors 27R and 27R are remaining closed).

Next, the image forming apparatus in fourth embodiment of the present invention will be described with reference to drawings. The portions of the image forming apparatus in this embodiment, which are the same as the counterparts in the above described first and second embodiments will be given the same referential codes as those given to the counterparts, and will not be described. FIG. 26 is a plan view of the connecting means 60 of the image forming apparatus in the fourth embodiment of the present invention, which is in the state in which the fixation nip is under pressure (first and second doors are remaining closed).

Referring to FIG. 26, the image forming apparatus in this embodiment is similar to the image forming apparatus in the second embodiment, except that the image forming apparatus in this embodiment has the connecting means 60 and a return spring 45, in place of the gear shaft 41, fan-shaped gear 42, links 32F and 32R, and link guide 34.

The connecting means 60 has a U-shaped portion 60*a* (connecting portion) and a protruding portion 60F (which hereafter will be referred to simply as protrusion 60F). In terms of the lengthwise direction of the connecting means 60, the U-shaped portion 60*a* is roughly at the middle of the connecting means 60, and the protrusion 60F is at one end. The connecting means 60 is rotatable about a shaft 60*b*, which also is at the middle of the connecting means 60 in terms of the lengthwise direction of the connecting means 60, but on the opposite surface of the connecting means 60 from the surface which has the U-shaped portion 60*a*.

The U-shaped portion 60*a* can be engaged with, or disengaged from, the key portion 50*a*, which is a part of the cam with which the fixation unit is provided, so that the fixing apparatus 8 can be mounted into, or dismounted from the apparatus main assembly 1 as it is in the second embodiment.

The projection 60F is allowed to slide in the elongated guiding hole 30Fa, with which the end portion of the arm 30F is provided. The projection 60R is allowed to slide in the elongated guiding hole 30Ra, with which the end portion of the arm 30R is provided.

The return spring 45 is between the adjacency of the protrusion 60F and the apparatus main assembly 1.

Figure 27:
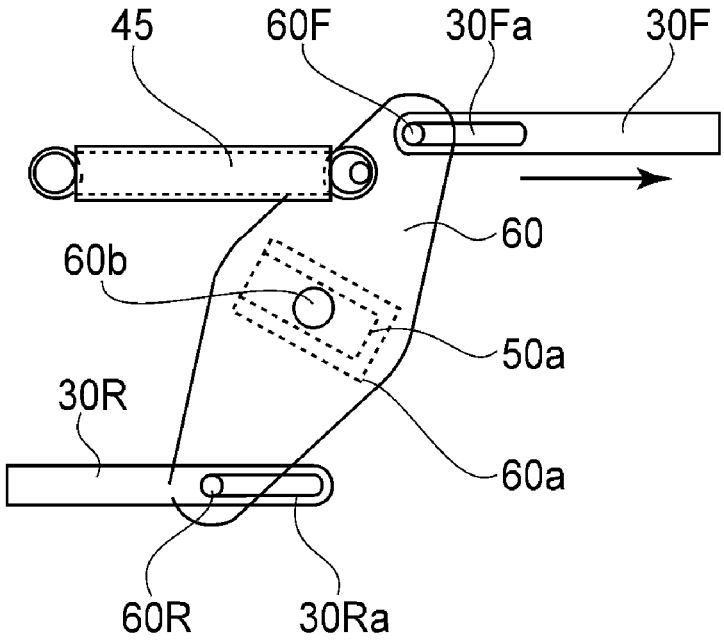
FIGS. 27(*a*) and 27(*b*) are plan views of the mechanical linkage shown in FIG. 26 when the fixation unit is not under pressure (only door 27R is open, and both door 27F and 24R are open, respectively).
Figure 27:
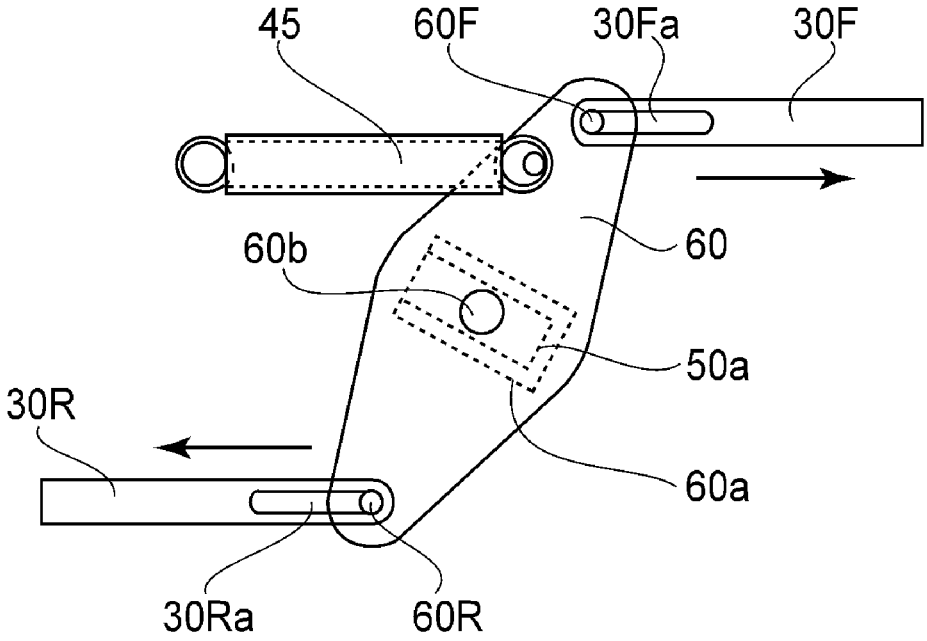

FIG. 27(*a*) is a plan view of the connecting means 60 when the fixation nip is not under pressure (when first door 27F is open). FIG. 27(*b*) is a plan view of the connecting means 60 when the fixation unit is not under pressure (both first and second door 27F and 27R are open).

Referring to FIG. 27(*a*), as the door 27F is opened, the arm 30F is pulled by the opening movement of the door 27F, whereby the projection 60F is pulled, causing thereby the connecting means 60 to rotate about the shaft 60*b*. This rotational movement of the connecting means 60 causes the cam 50 to rotate by way of the U-shaped portion 60*a* and key portion 50*a*. During this action, the projection 60R is allowed to slidingly move in the guiding hole 30Ra. Thus, even while the connecting means 60 rotates, the arm 30R is not subjected to any force, and therefore, does not move (it does not cause door 27F to open).

As the door 27F is closed when it is in the state shown in FIG. 27(*a*), the connecting means 60 is rotated by the return spring 45 into the position shown in FIG. 26. Incidentally, even if it is only the door 27R that is opened or closed, the arm 30R causes the connecting means 60 to rotate. Therefore, the connecting means 60 moves in the same manner as it does when the door 27F is opened.

Next, referring to FIG. 27(*b*), if the door 27R is opened when the door 27F is open, the projection 60R slides in the guiding hole 30Ra. Thus, the connecting means 60 is not subjected to any force, and therefore, does not rotate.

As both the doors 27F and 27R are closed, the connecting means 60 is rotated by the return spring 45 into the state shown in FIG. 26.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Applications Nos. 093275/2009 and 136797/2009 filed Apr. 7, 2009 and Jun. 8, 2009, respectively, which are hereby incorporated by reference.

What is claimed is:

1. An image forming apparatus comprising:

a main assembly;

a first openable member openably and closably provided in said main assembly;

a second openable member openably and closably provided in said main assembly;

a fixing unit for fixing a toner image formed on a recording material in said main assembly, said fixing unit including a pressure applying mechanism for applying a pressure to a fixing nip of said fixing unit, a first arm for transmitting a first operation force, generated when said first openable member is opened by the operator, to said pressure applying mechanism to release the pressure applied to the fixing nip;

a second arm for transmitting a second operation force, generated when said second openable member is opened by the operator, to said pressure applying mechanism to release the pressure applied to the fixing nip;

wherein said fixing unit is detachably mountable relative to the main assembly and includes a pressure switching member, engaged to said pressure applying mechanism, to receive the first operation force via said first arm when said first openable member is opened and to move said pressure applying mechanism, and wherein the second operation force generated when said second openable member is opened is transmitted to said pressure switching member.

2. An apparatus according to claim 1, further comprising a connecting member provided in said main assembly at a position upstream of said pressure switching member with respect to a direction in which the first and second operation forces are transmitted, with the first operation force generated when said first openable member is opened and the second operation force generated when said second openable member is opened being transmitted to said connecting member, and being transmitted from said connecting member to said pressure switching member.

3. An apparatus according to claim 2, wherein in an attitude of said connecting member in a state that at least one of said first openable member and said second openable member are opened, said pressure switching member acts on said pressure applying mechanism to keep it in a pressure release state, and said fixing unit is mountable and demountable relative to said main assembly.

4. An apparatus according to claim 1, further comprising a link mechanism which includes a first link for receiving the first operation force transmitted from said first arm, a second link for receiving the second operation force transmitted from said second arm, and a link guide for movably supporting said first link and said second link, wherein a triangular shape is constituted by said link guide, said first link and said second link, and a height of the triangular shape from said link guide changes in accordance with a state of opening and closing of said first openable member and said second openable member to change a position of said pressure switching member.

5. An apparatus according to claim 1, wherein said first openable member is operable when a cartridge for forming the toner image on the recording material is mounted and demounted relative to said main assembly of the image forming apparatus.

6. An apparatus according to claim 5, wherein said second openable member is operable exclusively when the pressure applied to said fixing nip is released.

7. An apparatus according to claim 5, wherein said second openable member is operable when said fixing unit is mounted and demounted relative to the main assembly.

8. An apparatus according to claim 5, wherein said second openable member has a tray function for receiving the recording material in a face-up state.

* * * * *